US007740560B2

(12) United States Patent
Tadin et al.

(10) Patent No.: US 7,740,560 B2
(45) Date of Patent: Jun. 22, 2010

(54) STATIONARY CHILD EXERCISE APPARATUS WITH BOUNCING PAD

(75) Inventors: Jeffrey S. Tadin, Canton, GA (US); Stephen R. Burns, Cumming, GA (US); Jacob M. Sclare, Dacula, GA (US); James E. Cartabiano, Gainesville, GA (US)

(73) Assignee: Kids II, Inc., Alpharetta, GA (US)

( * ) Notice: Subject to any disclaimer, the term of this patent is extended or adjusted under 35 U.S.C. 154(b) by 842 days.

(21) Appl. No.: 11/136,158

(22) Filed: May 24, 2005

(65) Prior Publication Data

US 2005/0264088 A1 Dec. 1, 2005

Related U.S. Application Data

(60) Provisional application No. 60/574,088, filed on May 26, 2004.

(51) Int. Cl.
*A63B 5/11* (2006.01)

(52) U.S. Cl. ..... 482/27

(58) Field of Classification Search ..... 482/27–29, 482/66–69, 77, 35–37; 280/87.051
See application file for complete search history.

(56) References Cited

U.S. PATENT DOCUMENTS

| | | | | |
|---|---|---|---|---|
| 974,491 | A * | 11/1910 | Huebner | 135/100 |
| 2,606,593 | A | 8/1952 | Beurskens | |
| 3,195,890 | A * | 7/1965 | Salls | 482/128 |
| 3,701,529 | A | 10/1972 | Kruthaupt | |
| 3,886,607 | A * | 6/1975 | Dunn | 5/104 |
| 4,037,834 | A | 7/1977 | Oaks | |
| 4,743,008 | A * | 5/1988 | Fermaglich et al. | 482/54 |
| 4,836,530 | A | 6/1989 | Stanley, Jr. | |
| 4,900,011 | A | 2/1990 | Nolet | |
| 5,080,383 | A * | 1/1992 | Hsieh | 280/87.051 |
| 5,211,607 | A | 5/1993 | Fermaglish et al. | |
| 5,302,163 | A | 4/1994 | Fermaglich et al. | |

(Continued)

FOREIGN PATENT DOCUMENTS

| | | |
|---|---|---|
| EP | 0 275 497 | 12/1987 |

OTHER PUBLICATIONS

PCT Search Report for Application PCT/US2005/018219, filed May 24, 2005.

*Primary Examiner*—Fenn C Mathew
(74) *Attorney, Agent, or Firm*—Alston & Bird LLP

(57) ABSTRACT

The invention is directed to a stationary exercise apparatus for small children. The apparatus includes an activity table adapted for receiving one or more children's activity items, one or more legs, a seat supported by the legs, and a resilient support surface suspended generally horizontally from at least one of the legs. The seat has a pair of leg openings that allow the child to touch the resilient support surface with its legs, and the resilient support surface has a resiliency that allows the child to bounce vertically by pushing its legs downwardly against the resilient support surface. Furthermore, the distance between the resilient support surface and the seat can be increased or decreased to account for the height of the child placed within the apparatus by moving the resilient support surface, and a tension element of the resilient support surface can be adjusted to account for the child's strength.

25 Claims, 29 Drawing Sheets

U.S. PATENT DOCUMENTS 5,380,023 A * 1/1995 McBee ..... 280/87.01
5,411,279 A * 5/1995 Magid ..... 280/47.38
5,518,475 A 5/1996 Garland
5,569,131 A * 10/1996 Giulianelli ..... 482/77
5,575,738 A 11/1996 Millington et al.
5,688,211 A 11/1997 Myers
5,690,383 A 11/1997 Meeker
5,729,852 A 3/1998 Rabideau et al.
5,788,606 A * 8/1998 Rich ..... 482/27
5,813,681 A 9/1998 Saint et al.
5,857,944 A 1/1999 Cone et al.
5,921,567 A * 7/1999 Brown ..... 280/87.051
5,934,747 A 8/1999 Garland
5,984,837 A 11/1999 Weaver et al.
6,000,750 A 12/1999 Rossman et al.
6,053,845 A * 4/2000 Publicover et al. ..... 482/35
D429,116 S 8/2000 Mount
6,110,074 A 8/2000 Tacquet
6,174,266 B1 * 1/2001 Merrill ..... 482/35
6,299,247 B1 10/2001 Meeker et al.
6,375,599 B1 4/2002 Brown
6,560,795 B2 5/2003 Hsia
6,675,413 B2 1/2004 Hsia
6,676,475 B1 1/2004 Henderson et al.
7,297,089 B2 * 11/2007 Chen ..... 482/27

* cited by examiner

STATIONARY CHILD EXERCISE APPARATUS WITH BOUNCING PAD

CROSS-REFERENCE TO RELATED APPLICATIONS

This application claims priority from provisional U.S. Application No. 60/574,088 entitled "Stationary Walker with Bouncing Pad," which was filed on May 26, 2004 and which is hereby incorporated by reference in its entirety.

BACKGROUND OF THE INVENTION

Stationary exercise apparatuses are used to assist children in the development of the muscles and coordination needed for walking. A typical stationary child exercise apparatus includes a seat portion that is positioned in the center of the apparatus and is at least partially surrounded by an annular-shaped activity tray. The activity tray includes toys that entertain the child. The stationary apparatus is held in a stationary position by legs that extend downwardly from the activity tray. In most stationary exercise apparatuses, the seat portion can rotate 360°, independently of the activity tray, about an axis of rotation that is defined by the center of the seat portion.

U.S. Pat. No. 6,299,247 to Meeker ("the '247 Patent") discloses a child exerciser/rocker that includes a bowl-shaped base adapted to rock in any direction, three equally spaced towers extending upwardly from the upper periphery of the base, a circular tray that is positioned on top of the towers, and a seat for receiving a child that is rotatably mounted in the center of the tray. The towers include springs to allow a child positioned in the seat to bounce with respect to the base, and the heights of the towers are adjustable. However, the base itself does not bounce and the vertical motion provided by the springs in the towers is felt by the child through the seat, and not through the child's legs. In addition, the seat and circular tray move together when the child bounces in the rocker, which may cause food or drinks on the tray to spill.

U.S. Pat. No. 3,195,890 to Salls ("the '890 Patent") discloses a resilient action jumping toy that includes an upstanding, cylindrical-shaped framework with a foot-engageable platform at the bottom of the framework. Between the platform and the floor are compressible elastic energy storing means, such as compression springs, that provide oscillatory movement to the platform when a child standing on the platform jumps up and down. However, because the jumping toy does not have a seat for supporting a child over the foot engageable platform, the toy is unsuitable for small children that have not yet developed the muscles and coordination needed for standing. In addition, the compressive elastic energy storing means cannot be adjusted to increase or decrease the amount of oscillatory movement of the platform.

U.S. Pat. No. 4,900,011 to Nolet ("the '011 Patent") discloses an exerciser and playpen structure that has a trampoline like bottom surface. A child standing on the resilient surface can grip an upper frame of the structure with its hands and move its legs up and down to take advantage of the rebounding effect of the resilient surface. However, like the jumping toy of the '890 Patent, this structure does not include a seat for supporting a child that has not yet developed the muscles and coordination needed for standing, and the tension of the resilient surface cannot be increased or decreased.

Therefore, an unsatisfied need in the art exists for a stationary child exercise apparatus that is able to support a child over a resilient surface while the child develops the muscles and coordination needed for standing and walking and allows for the adjustment of a tension element of the resilient surface.

BRIEF SUMMARY OF THE INVENTION

The invention is directed to a stationary exercise and activity apparatus for providing cognitive development activities for small children and exercise functionality. In one embodiment, the apparatus includes an activity table adapted for receiving one or more children's activity items, one or more legs supported on a floor, a seat supported by the legs, and a resilient support surface suspended generally horizontally from at least one of the legs. The seat has a pair of leg openings that allow the child to touch the resilient support surface with its legs, and the resilient support surface has a resiliency that allows the child to bounce vertically by pushing its legs downwardly against the resilient support surface. Furthermore, the distance between the resilient support surface and the seat can be increased or decreased to account for the height of the child placed within the apparatus by moving the resilient support surface, and a tension element of the resilient support surface can be adjusted to account for the strength of the child.

In one embodiment, the legs extend downwardly and outwardly toward the floor. When the resilient support surface is moved closer to the seat, the tension element of the resilient support surface is decreased, resulting in a child having to apply less force with its legs to achieve a bouncing motion. When the resilient support surface is moved closer to the floor, the tension element is increased, resulting in the child having to apply more force with its legs to achieve a bouncing motion. This feature advantageously accounts for the gradual development of the child's muscles and coordination by automatically adjusting the tension element of the resilient support surface based on the size of the child.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Generally, the present invention is directed to a children's stationary exercise apparatus. In one embodiment, the apparatus includes a seat, one or more legs depending downwardly towards a floor and supporting the seat, an activity table, and a resilient support surface, or bouncing pad. The seat is mounted in the center of the activity table and can be configured to rotate 360° about its own axis of rotation. The legs extend downwardly and outwardly from the seat, and the resilient support surface is suspended horizontally from the legs and is positioned vertically between the seat and the floor. A child positioned within the apparatus pushes its legs against the resilient support surface to achieve an up and down bouncing motion. This bouncing motion assists in the development of the muscles and coordination needed for standing and walking. Furthermore, the distance between the resilient support surface and the seat can be increased or decreased to account for the height of the child by lowering or raising the resilient support surface, and, in one embodiment, a tension element of the resilient support surface is increased as the distance between the seat and the resilient support surface is increased, which provides more resistance for the child's legs.

Figure 1:
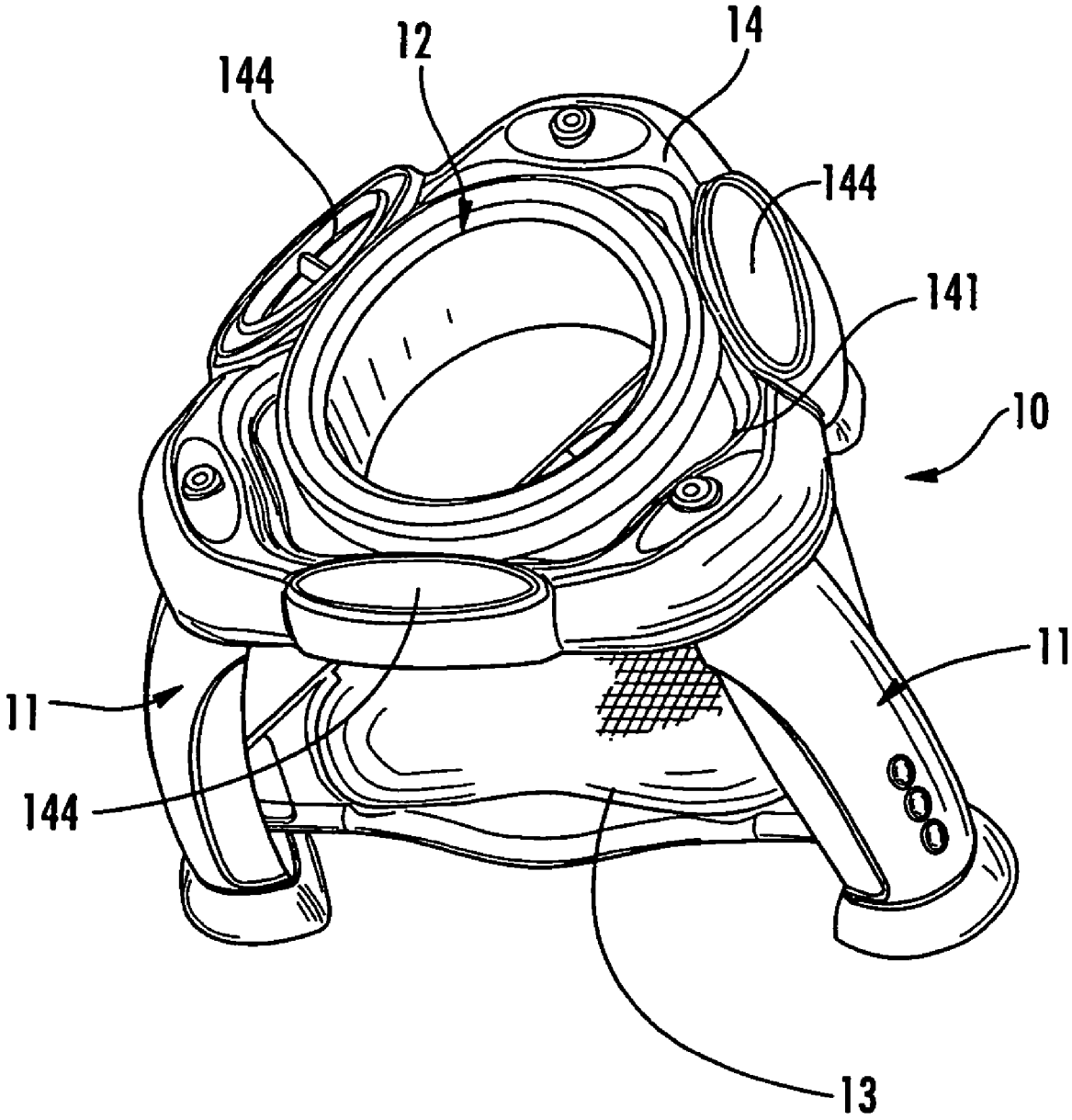
FIG. 1 shows a perspective view of a stationary child exercise apparatus according to one embodiment of the invention.
Figure 2:
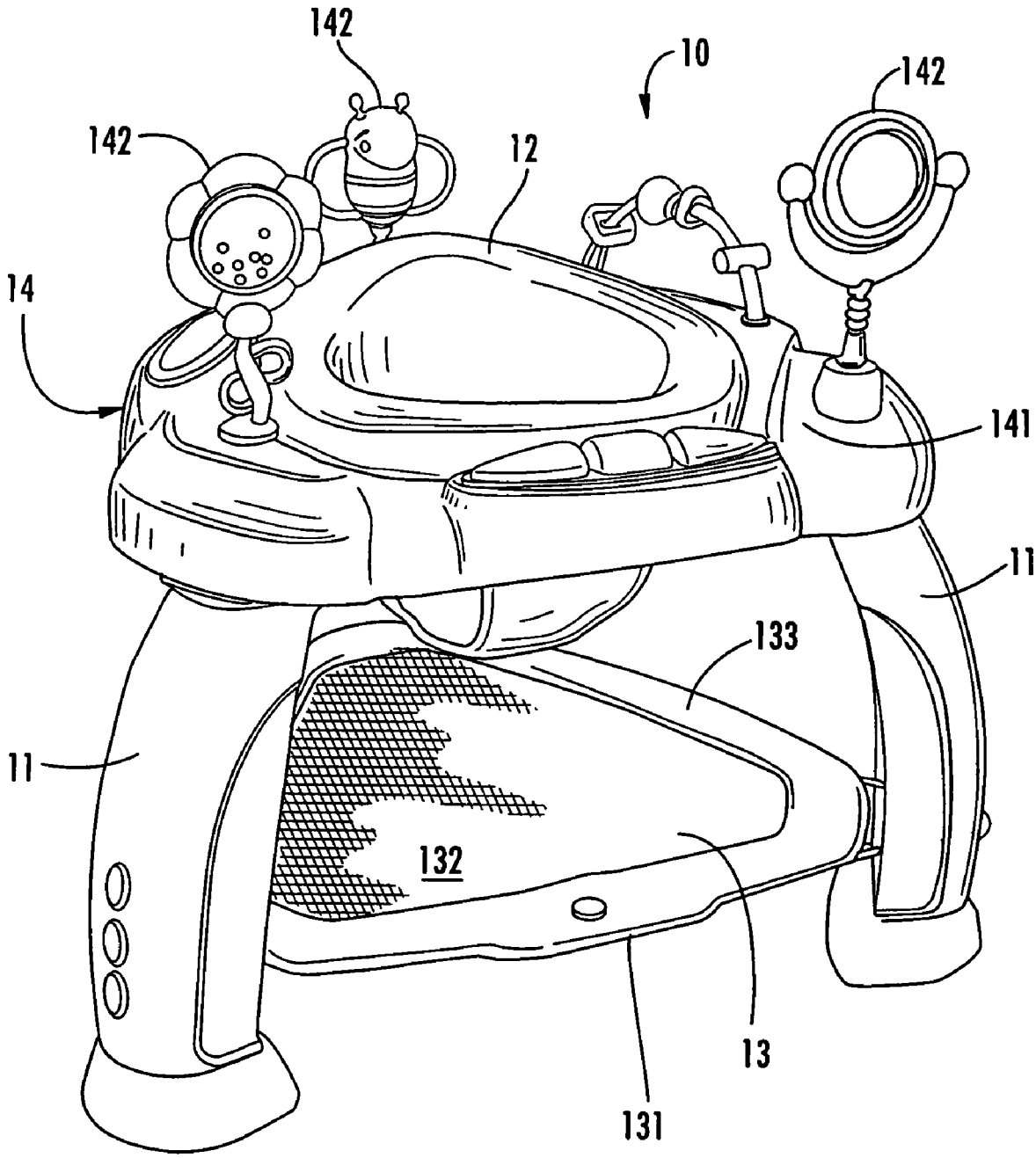
FIG. 2 shows a perspective view of a stationary child exercise apparatus according to another embodiment of the invention.
Figure 3:
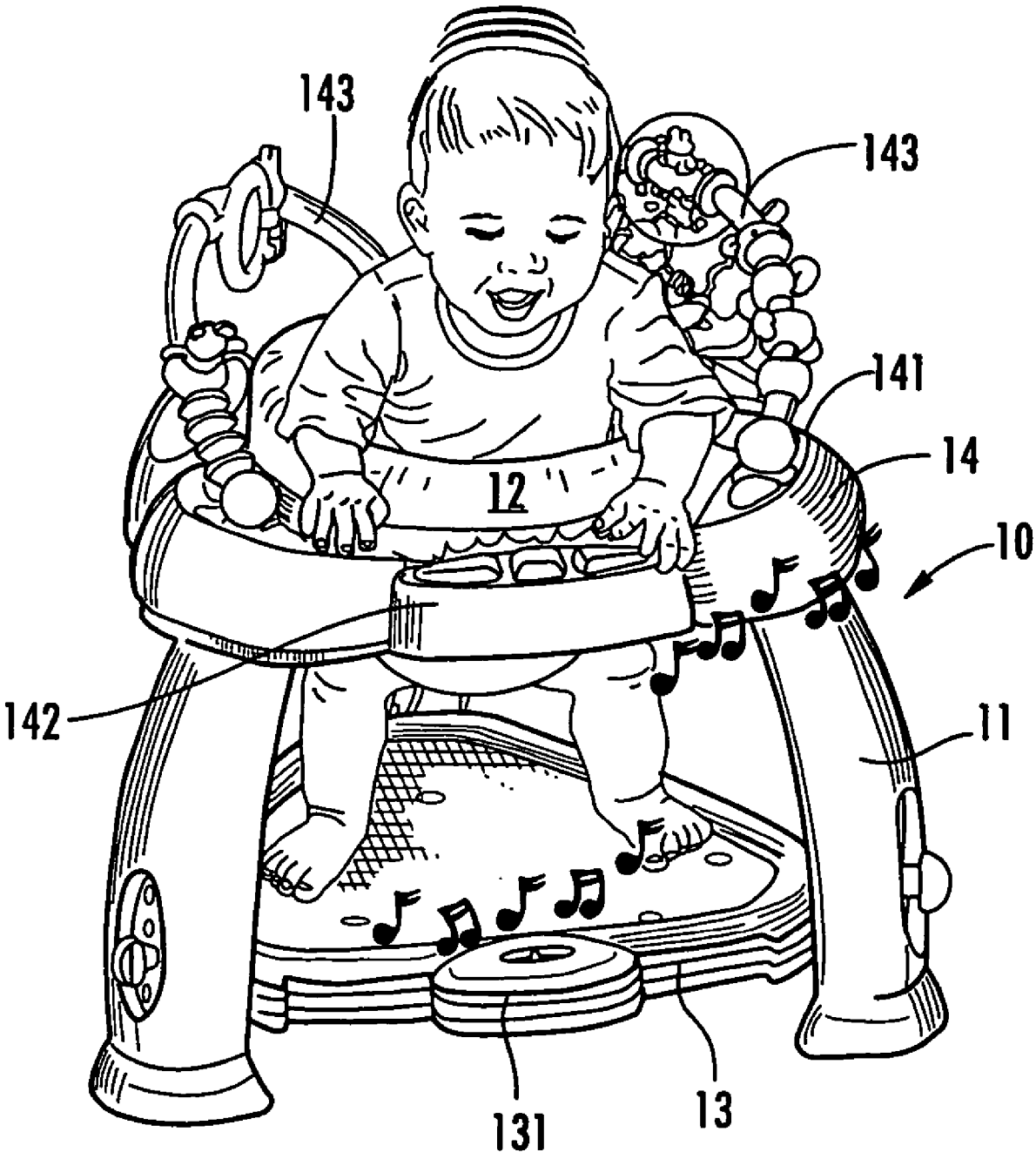
FIG. 3 shows a perspective view of a stationary child exercise apparatus according to another embodiment of the invention.
Figure 4:
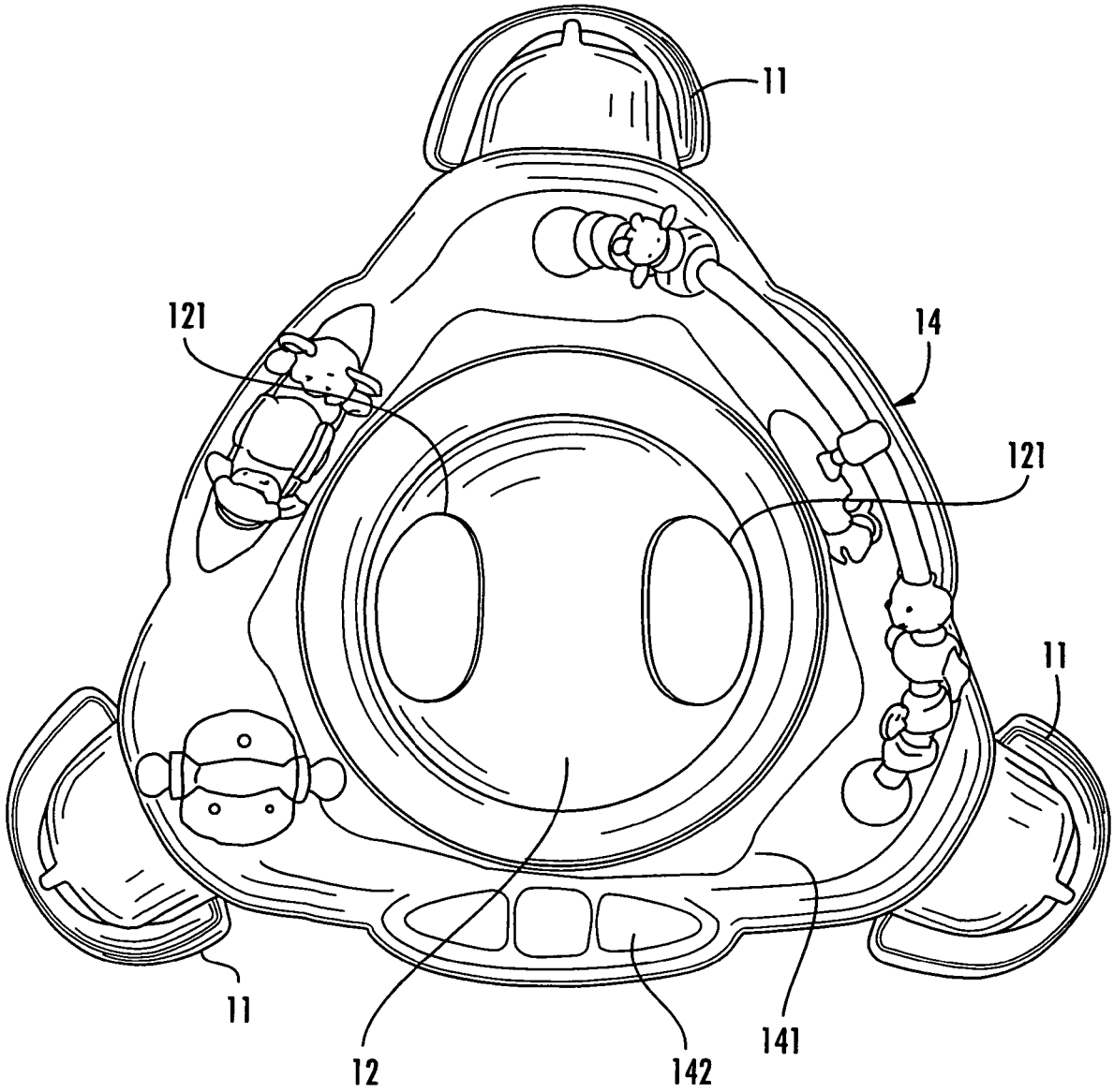
FIG. 4 shows a top view of a stationary child exercise apparatus according to one embodiment of the invention.

As shown in FIG. 1, one embodiment of the invention is a children's exercise apparatus 10 for providing exercise functionality for a small child. The apparatus 10 includes one or more legs 11 supported on a floor, a seat 12 supported by the legs 11 and structured to support the child while allowing the child's legs to extend downwardly below the seat 12, and a resilient support surface 13 that is suspended generally horizontally from the legs 11 and positioned vertically between the seat 12 and the floor. The resilient support surface 13 has a resiliency that is adapted for allowing the child to bounce vertically by pushing its legs downwardly against the resilient support surface 13. As shown in FIG. 2, a further embodiment of the apparatus 10 includes an activity table 14 that includes an upper surface 141 for supporting activity items 142, such as toys, teething rings, and interactive learning modules. FIG. 3 illustrates another embodiment of an activity table 14 that includes toy bars 143 on the upper surface 141 of the activity table 14 on which activity items may be mounted. Further, as shown in FIG. 4, the seat 12 defines a pair of leg openings 121 that allow the child to touch the resilient support surface 13 with its legs.

The various embodiments of the elements of the apparatus 10 are discussed in more detail below. However, these embodiments are exemplary and should not limit the scope of the invention, and one or more features from one embodiment could be combined with features from other embodiments.

Seat

The seat 12, according to one embodiment, includes a seat carrier ring 201 and a seat support ring 211. As shown schematically in FIG. 6, an annular horizontal surface 202 on the seat carrier ring 201 is mounted adjacent to and vertically supported by an annular horizontal surface 212 of the seat support ring 211, and a central axis B of the seat support ring 211 is coaxial with a central axis A of the seat carrier ring 211. Thus, the seat carrier ring 201 can rotate 360° about the axis A, independently of the seat support ring 211.

Figure 6:
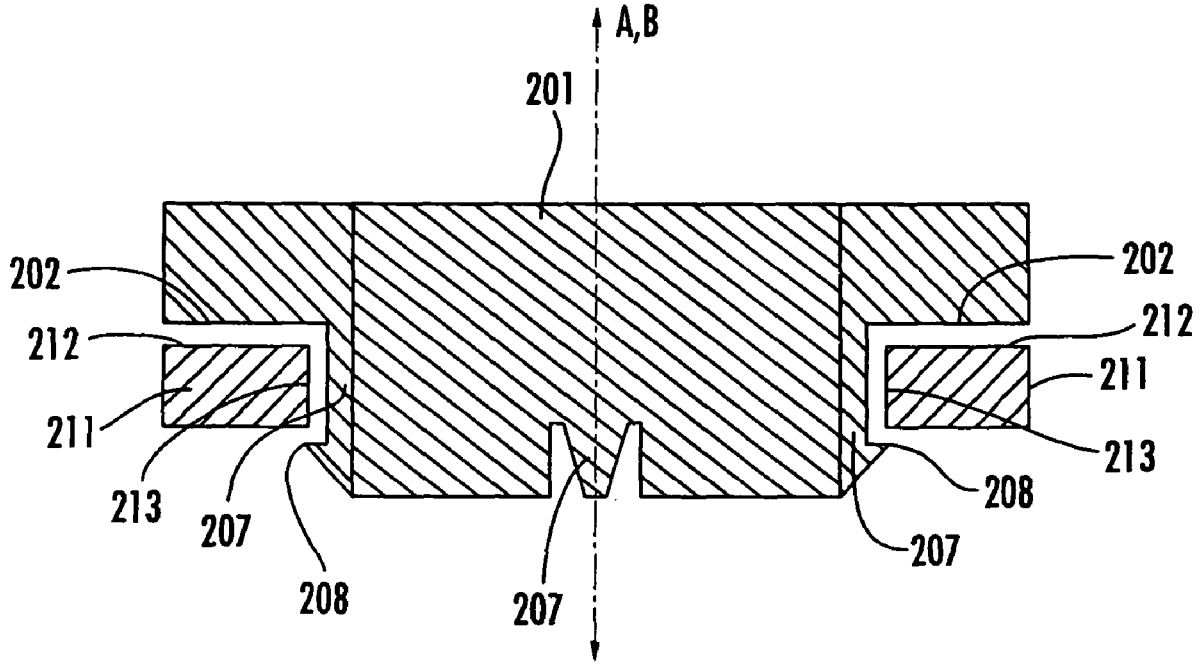
FIG. 6 shows a cross-sectional view of a seat carrier ring and a seat support ring according to one embodiment of the invention.
Figure 7:
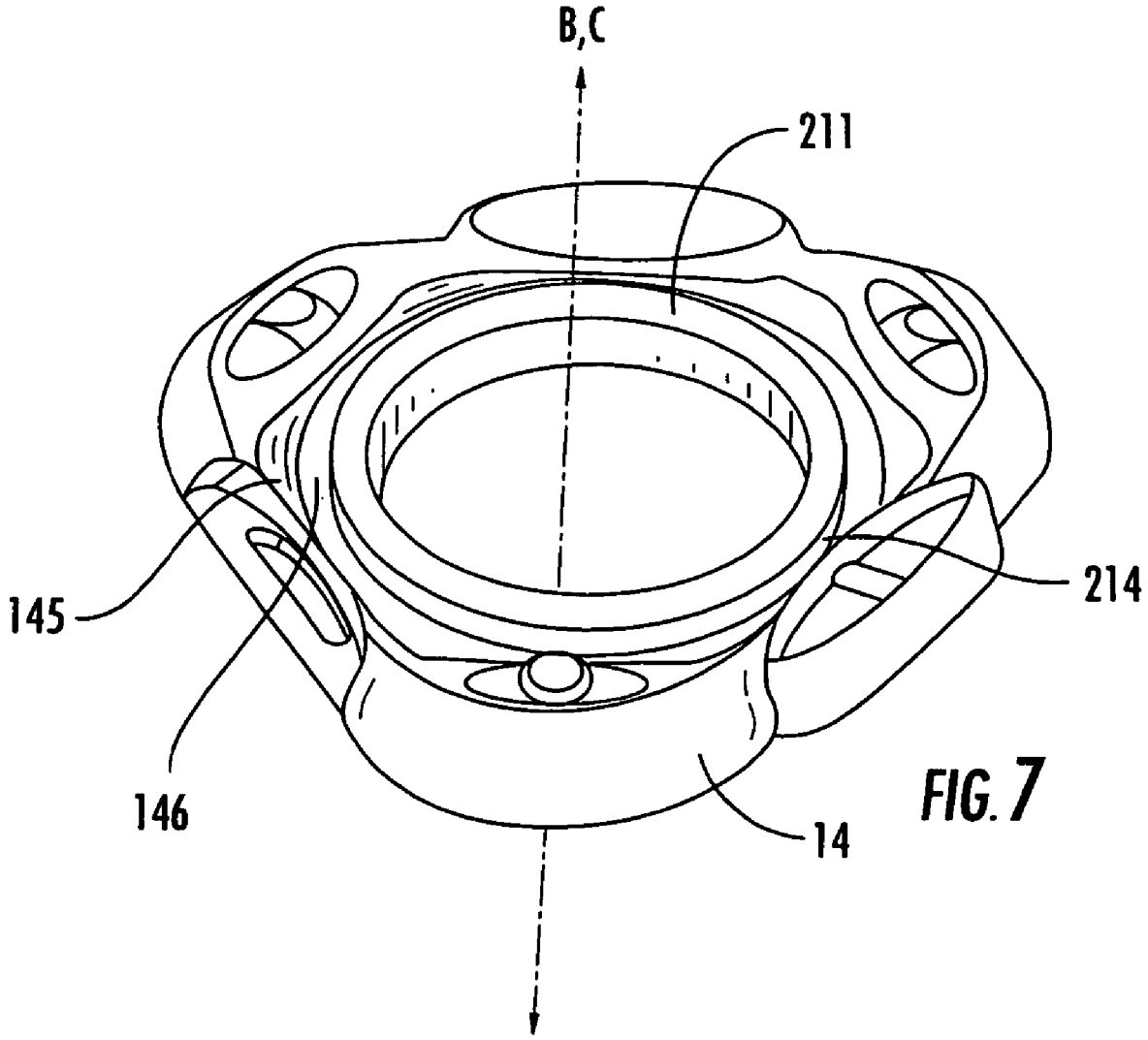
FIG. 7 shows a perspective view of an activity table and a seat support ring according to one embodiment of the invention.
Figure 8:
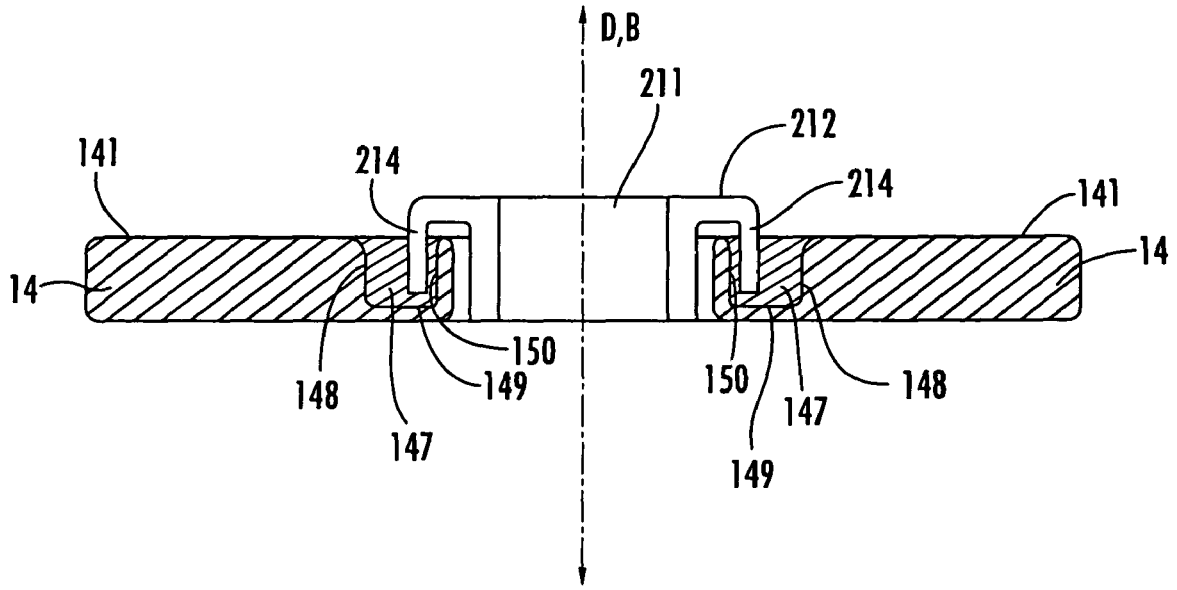
FIG. 8 shows a cross-sectional view of an activity table and a seat support ring according to one embodiment of the invention.

As shown in FIGS. 6 through 8, one embodiment of the seat support ring 211 has a central vertical axis B and includes an inner wall 213, an outer wall 214, and an annular horizontal engagement surface 212 positioned between the inner 213 and outer walls 214. The width of the annular horizontal engagement surface 212 is wide enough to provide vertical support for a seat carrier ring 201 mounted adjacent to the horizontal engagement surface 212. As will be discussed below in more detail in the section below entitled "Activity Table," one embodiment of the seat support ring 211 is integrally formed with an activity table 14, as shown in FIG. 7, and one embodiment of the seat support ring 211 is separate from the activity table 14, as shown in FIG. 8.

Figure 11:
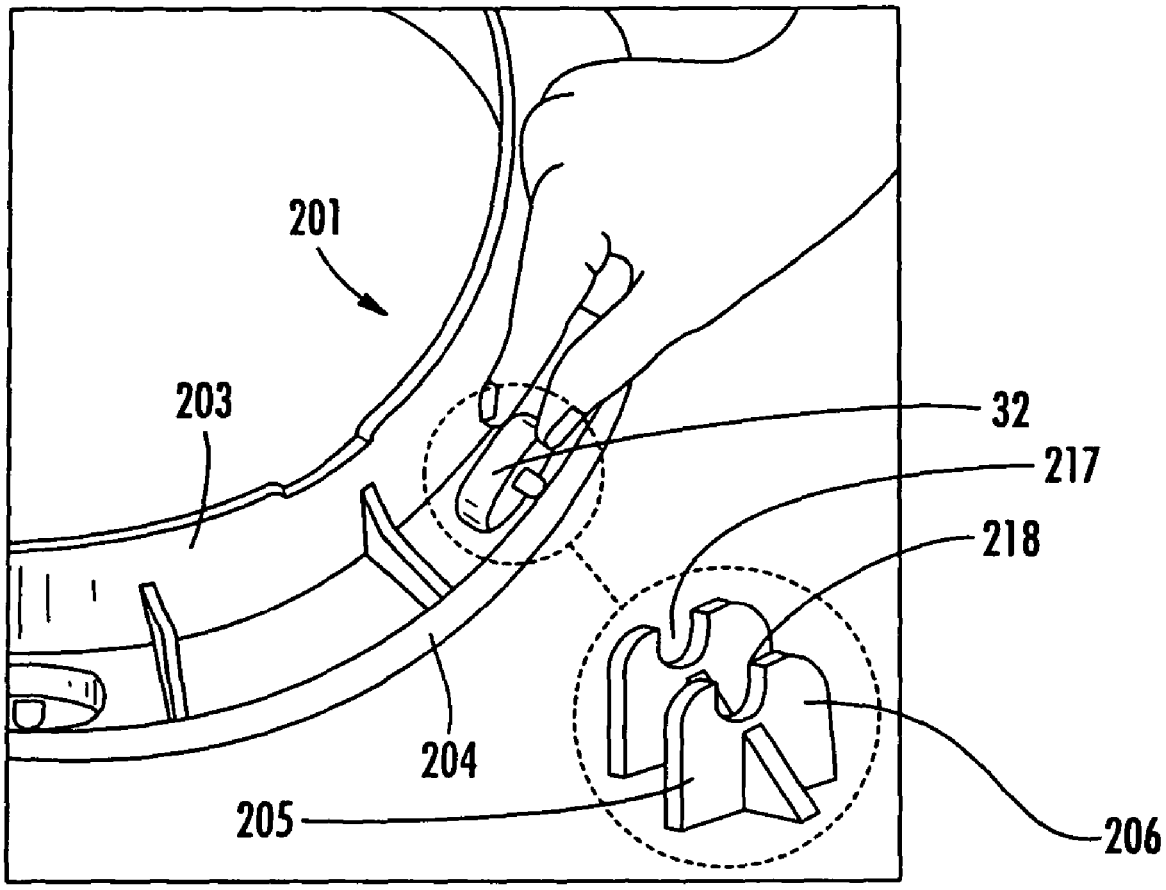
FIG. 11 shows a perspective view of a seat carrier ring according to one embodiment of the invention.
Figure 12:
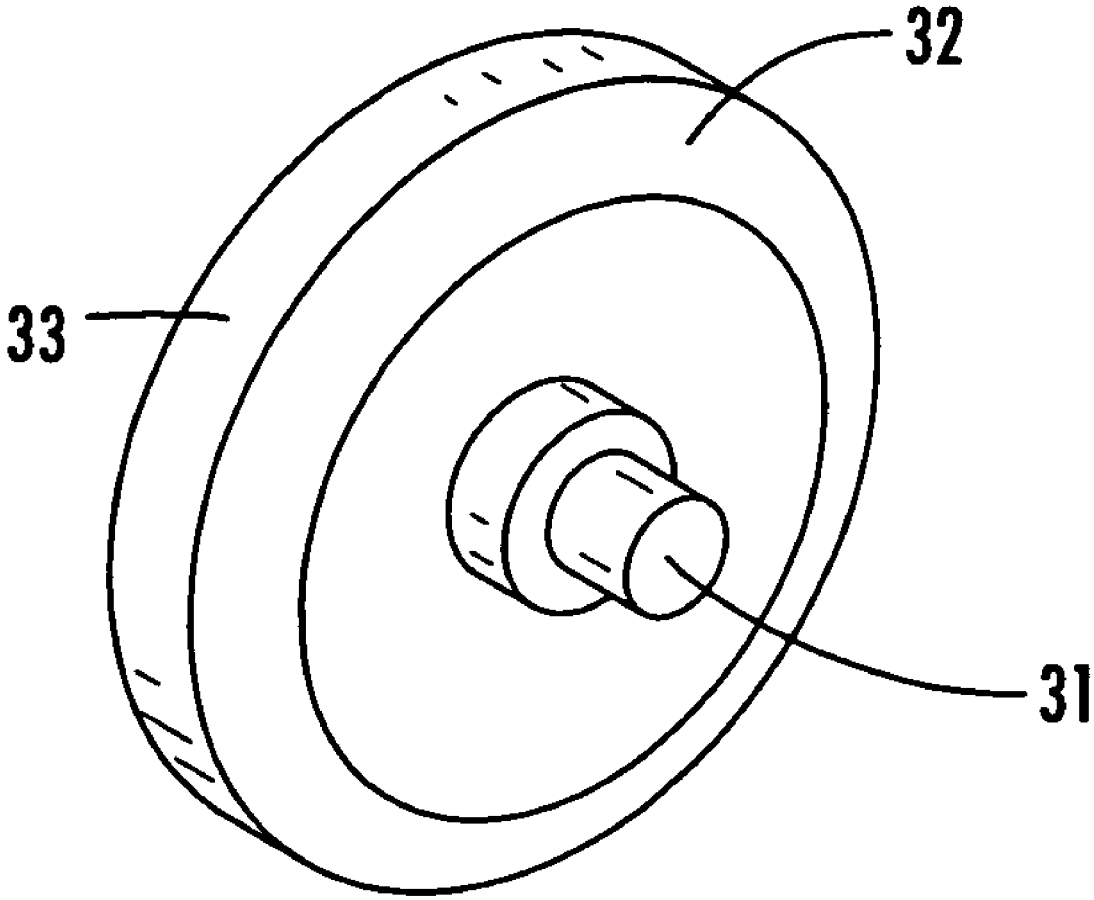
FIG. 12 shows a perspective view of a wheel according to one embodiment of the invention.

As mentioned above, the seat carrier ring 201 has a central vertical axis A and includes an inner wall 203, an outer wall 204, and a horizontal annular surface 202 positioned between the inner 203 and outer walls 204. In one embodiment, shown in FIGS. 5 and 11, the horizontal annular surface 202 of the seat carrier ring 201 includes a plurality of ribs 205 positioned between the inner wall 203 and outer wall 204. Each of the ribs 205 defines a mounting portion 206 that receives a roller 32. According to one embodiment, as shown in FIG. 11, the mounting portion 206 has a C-shaped cross section and defines an aperture 217 having the approximate diameter of an axis 31 of a wheel 32, shown in FIG. 12, and an opening 218 into the aperture 217 that has a width slightly less than the diameter of the axis 31 of the wheel 32. Thus, the axis 31 of the wheel 32 can be snapped into the C-shaped mounting portion 206. When the seat carrier ring 201 is positioned within the seat support ring 211, outer surfaces 33 of the wheels 32 engage the horizontal surface 212 of the seat support ring 211, and the wheels 32 rotate about their axes 31 to facilitate the rotation of the seat carrier ring 201 relative to the seat support ring 211.

Figure 5:
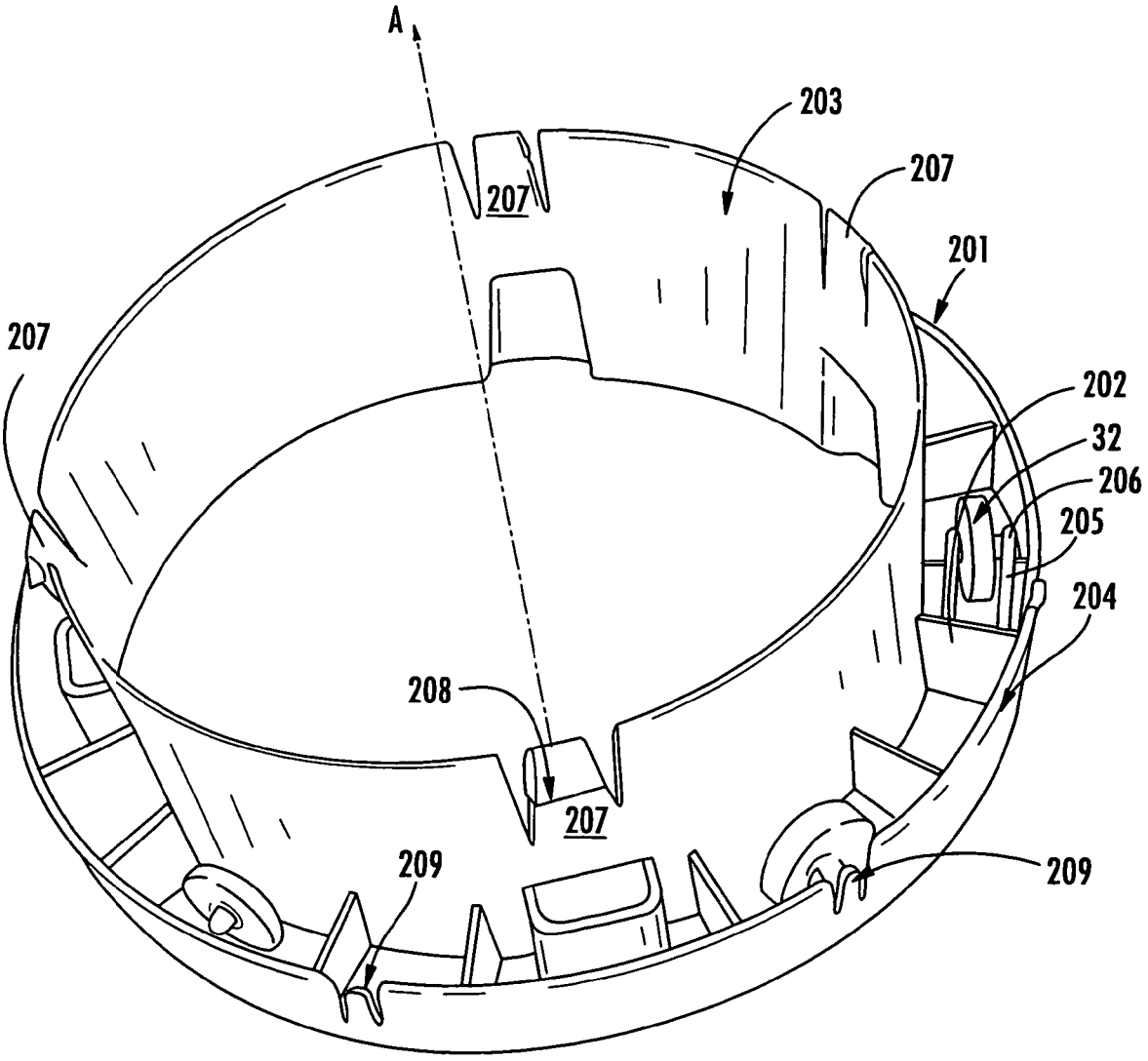
FIG. 5 shows a perspective view of a seat carrier ring according to one embodiment of the invention.

In a further embodiment, as shown in FIG. 5, the inner wall 203 of the seat carrier ring 201 extends below the lower surface 202 and includes one or more cantilevered latches 207. The cantilevered latches 207 include a horizontal shelf 208 that extends away from the central axis A of the seat carrier ring 201. The latches 207 are configured to deflect slightly inwardly towards the central axis A when the seat carrier ring 201 is inserted into the seat support ring 211. As shown in FIG. 6, when the seat carrier ring 201 is fully inserted into the seat support ring 211, the horizontal shelves 208 of the latches 207 are positioned below the inner wall 213 of the seat support ring 211 such that each horizontal shelf 208 is adjacent the bottom edge of the inner wall 213 of the seat support ring 211, preventing the seat carrier ring 201 from being unintentionally removed from the seat support ring 211. To remove the seat carrier ring 201 from the seat support ring 211, the latches 207 are pushed inwardly as the seat carrier ring 201 is urged upwardly.

Figure 13:
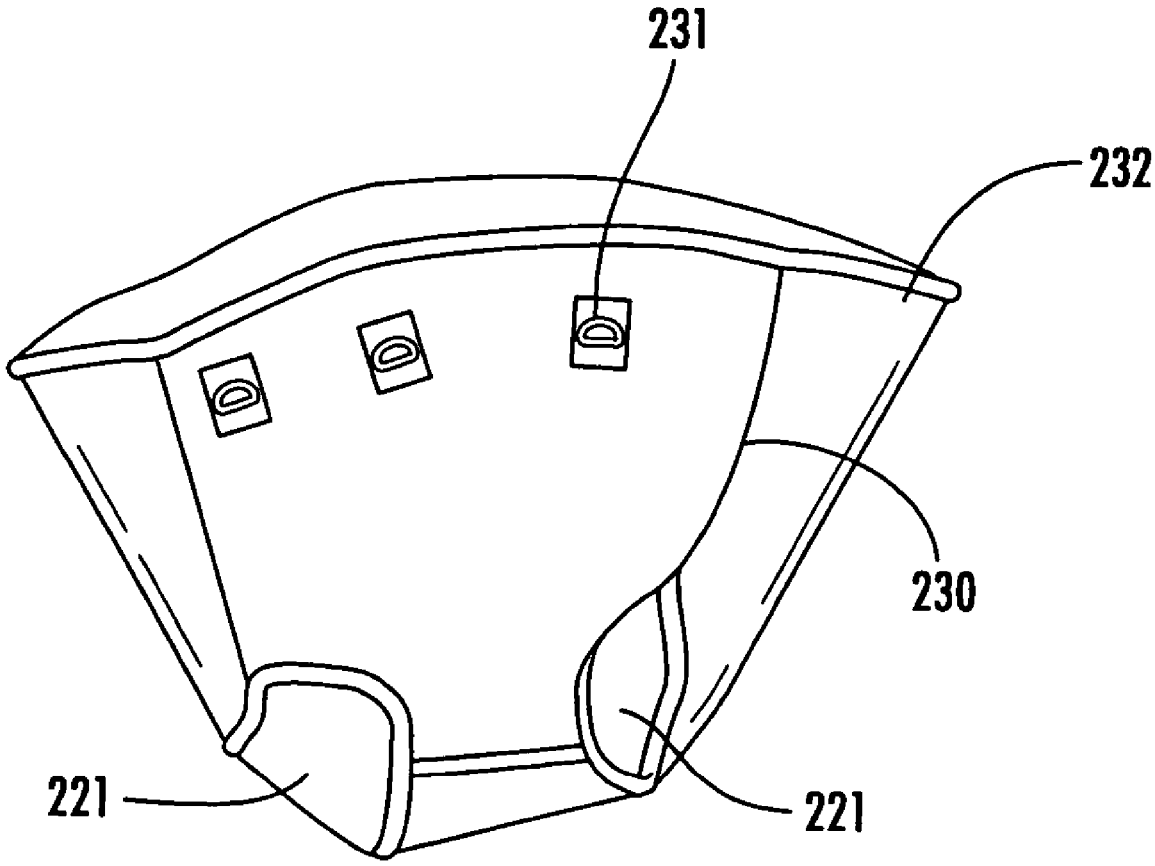
FIG. 13 shows a perspective view of a sling according to one embodiment of the invention.

FIG. 13 illustrates one embodiment of a fabric sling 230 that attaches to the seat carrier ring 201. Once attached to the seat carrier ring 201, the child can sit on the sling 230. In one embodiment, the sling 230 includes a pair of leg openings 221 that allow the child to touch the floor with its legs. In addition, the sling 230 includes loops 231 along a top portion 232 of the sling 230 to engage tabs 209, shown in FIG. 5, that extend downwardly from the outer wall 204 of the seat carrier ring 201. To secure the fabric sling 230 to the seat carrier ring 201, the sling 230 is positioned through the center of the seat carrier ring 230, the top portion 232 of the sling 230 is wrapped over the outer wall 204 of the seat carrier ring 201, and the loops 231 are hooked over the tabs 209. Alternatively, snaps, buttons, clips, or other suitable fasteners may be used to secure the sling 230 to the seat carrier ring 201.

Resilient Support Surface

As discussed above in relation to FIGS. 1 through 3, the exercise apparatus 10 includes a resilient support surface 13 that is suspended generally horizontally from the legs 11 and positioned vertically between the seat 12 and the floor. The resilient support surface 13 has a resiliency that allows the child to bounce vertically by pushing its legs downwardly against the resilient support surface 13. The resiliency may be provided by the support surface 13, by connectors that mount the support surface 13 adjacent to the mounting portions 112 of the legs 11, or both.

When the resiliency is provided by the support surface 13, at least in part, the support surface 13 is formed using various types of materials that provide resiliency. For example, in one embodiment, the support surface 13 is formed of a flexible material, such as nylon, natural or synthetic elastomers, rubber, fabric mesh, woven polypropylene, or fabric. In another embodiment, a center portion 132 of the support surface 13 is a flexible material and at least a portion of an outer periphery 133 of the support surface 13 is a rigid material, such as plastic, metal, or wood. And, in yet another embodiment, the center portion 132 is a rigid material and at least a portion of the outer periphery 133 is a flexible material.

In an embodiment in which the resiliency is provided at least in part by the connector, the support surface 13 may be formed of flexible material, rigid material, or a combination of both. Examples of connectors that provide resiliency include springs, rubber or elastic cords, or rubber rings.

Figure 14:
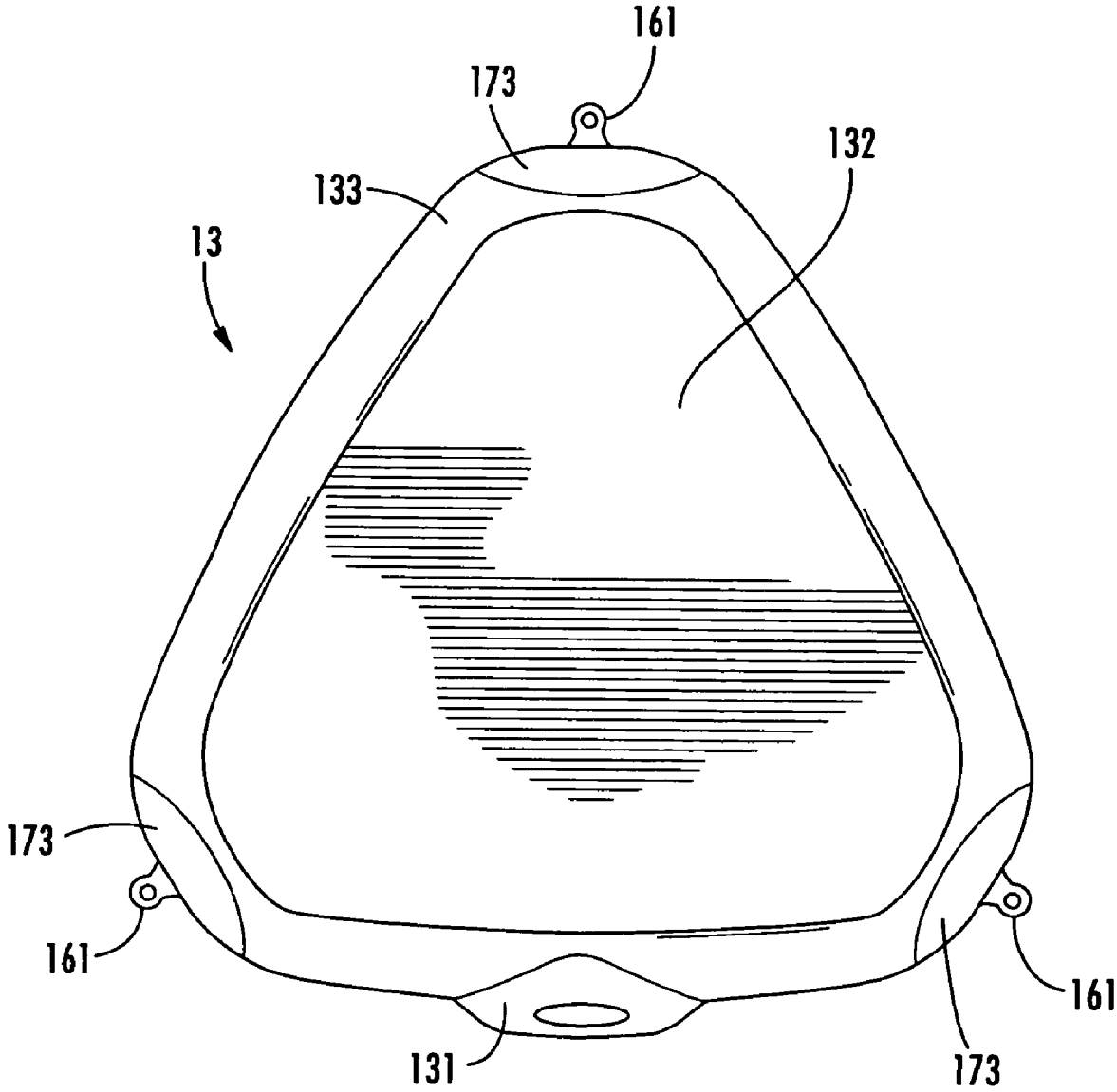
FIG. 14 shows a top view of a resilient support surface according to one embodiment of the invention.
Figure 15:
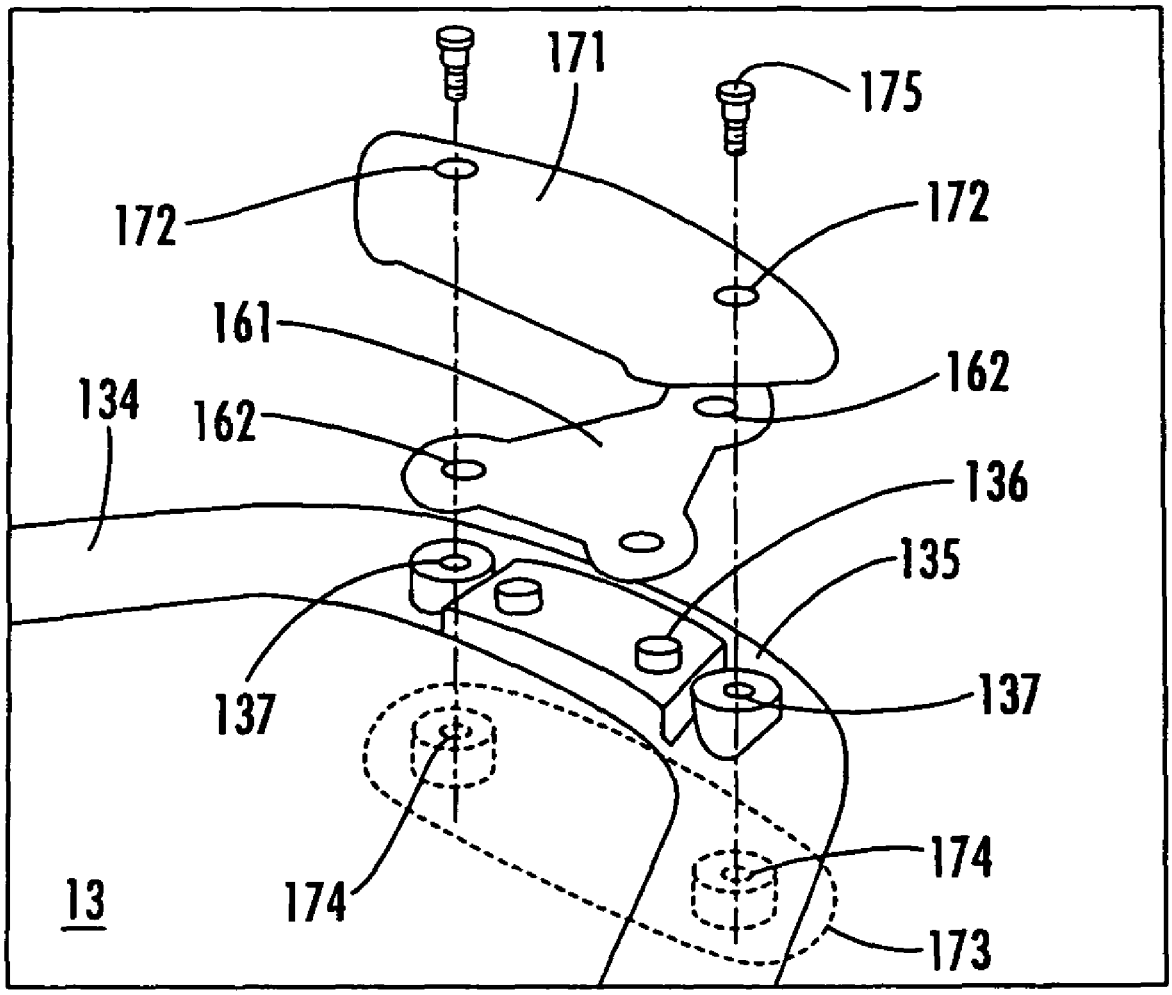
FIG. 15 shows a perspective view of a resilient support surface according to one embodiment of the invention.

FIG. 14 illustrates an embodiment in which the resilient support surface 13 is a rigid plastic board that has a triangular shape. As can be seen in more detail in FIG. 15, the corners of the resilient support surface 13 include connector portions 135. Each connector portion 135 includes two cylindrical protrusions 136 that extend downwardly from a lower surface 134 of the resilient support surface 13 and two threaded apertures 137 that are positioned adjacent to the cylindrical protrusions 136.

Compression molded rubber rings 161 are used to mount the resilient support surface 13 to mounting portions 112 of the legs 11. The rubber rings 161 have a triangular shape and define an aperture 162 at each vertex. Each aperture 162 has an inner diameter approximately the same as the outer diameter of the cylindrical protrusion 136 such that an aperture 162 can be aligned with and positioned over a cylindrical protrusion 136 of the resilient support surface 13. To secure the rubber ring 161 adjacent to the resilient support surface 13, a lower cover 171 is positioned over the connector portion 135 on the lower surface 134 of the resilient support surface 13 and an upper cover 173 is positioned over the connector portion 135 on an upper surface of the resilient support surface 13. The lower cover 171 includes two threaded apertures 172 that align with the threaded apertures 137 of the connector portion 135 and extend all the way through the lower cover 171. The upper cover 173 includes two threaded apertures 174 that extend partially through the upper cover 173. When both covers 171, 173 are in place, screws 175 are inserted into the threaded apertures 172 of the lower cover 171, through the apertures 137 of the connector portion 135, and into the apertures 174 of the upper cover 173. The third aperture 162 of the rubber ring 161 that is not positioned over the cylindrical protrusions 136 extends past the periphery of the resilient support surface 13 and engages a mounting portion 112 on a leg 11.

In an alternative embodiment (not shown), the resilient support surface 13 is suspended using springs. For example, a hook on one end of a helical tension spring is inserted into an aperture along the periphery of the support surface 13 and the other end of the spring is inserted into the mounting portion 112 on the leg 11. In another alternative embodiment, one or more elastic or rubber cords are secured to the resilient support surface 13 using tabs, grommets, or by threading the cord through a conduit on the periphery of the support surface 13, and the cord is pulled into tension when coupled to mounting portions 112 defined on the leg 11.

Any of the above described embodiments of the resilient support surface 13 may further include a contact sensor (not shown), such as an inertia sensor, and an electronic sound unit 131, which is shown in FIGS. 2, 3, and 14. The electronic sound unit 131 emits a sound in response to receiving a signal from the contact sensor that the sensor senses movement of the resilient support surface 13. Thus, the child hears a sound when the child pushes its legs against the resilient support surface 13, which mentally stimulates a child positioned in the apparatus 10. As shown in FIGS. 2, 3, and 14, the electronic sound unit 131 can be turned on and off by a switch. In addition, the resilient support surface 13 may be covered by a pad (not shown) to add comfort for the child's feet.

Legs and Mounting Portions

Figure 9A:
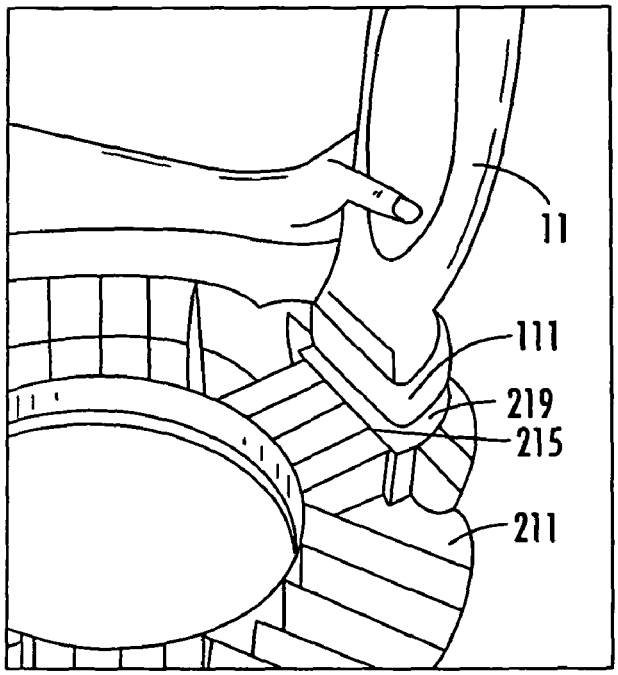
FIG. 9A shows a perspective view of a seat support ring and a leg according to one embodiment of the invention.
Figure 9B:
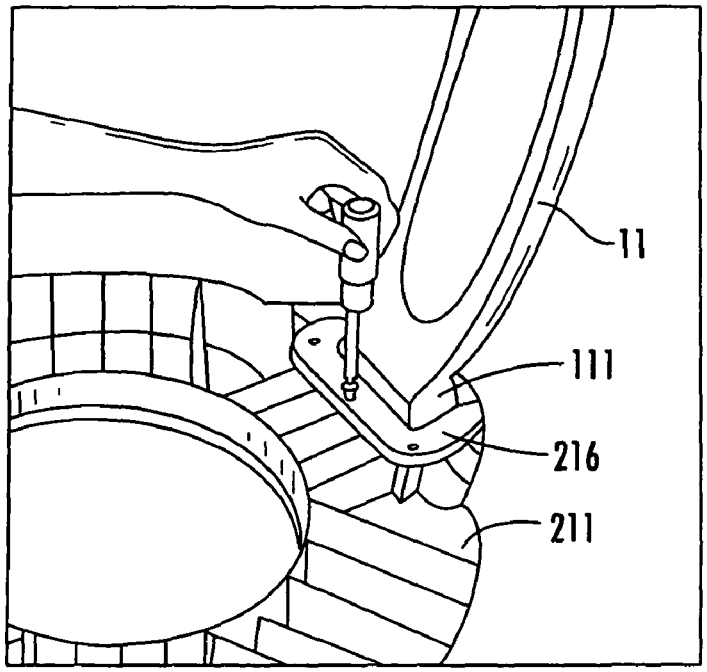
FIG. 9B shows a perspective view of a seat support ring and a leg according to one embodiment of the invention.

As discussed above, one or more legs 11 are supported on a floor, and the legs 11 support the seat 12. FIGS. 9A and 9B illustrate one embodiment of how the legs 11 are secured to the seat 12. In particular, the seat support ring 211 includes one or more leg mounting portions 215 adapted for receiving and securely fastening one or more legs 11 to the seat support ring 211. Each leg mounting portion 215 is C-shaped and has a horizontal surface 219 that is contiguous with a lower surface of the seat support ring 211. In addition, each C-shaped portion 215 defines an inner diameter, or an inner width and length. An upper end 111 of each leg 11 has an outer diameter, or outer width and length, that is approximately the same as the inner diameter of the leg mounting portions 215, allowing the upper end 111 of the leg 11 to fit adjacent to the leg mounting portion 215. To secure the leg 11 into the leg mounting portion 215, a C-shaped bracket 216 having an inner diameter that is approximately the same as the outer diameter of the upper end 111 of the leg 11 is placed around the upper end 111 of the leg 11 and fastened to the horizontal surface 219 of the leg mounting portion 215. In an alternative embodiment, the leg mounting portion 215 is part of the table 14.

Figure 10:
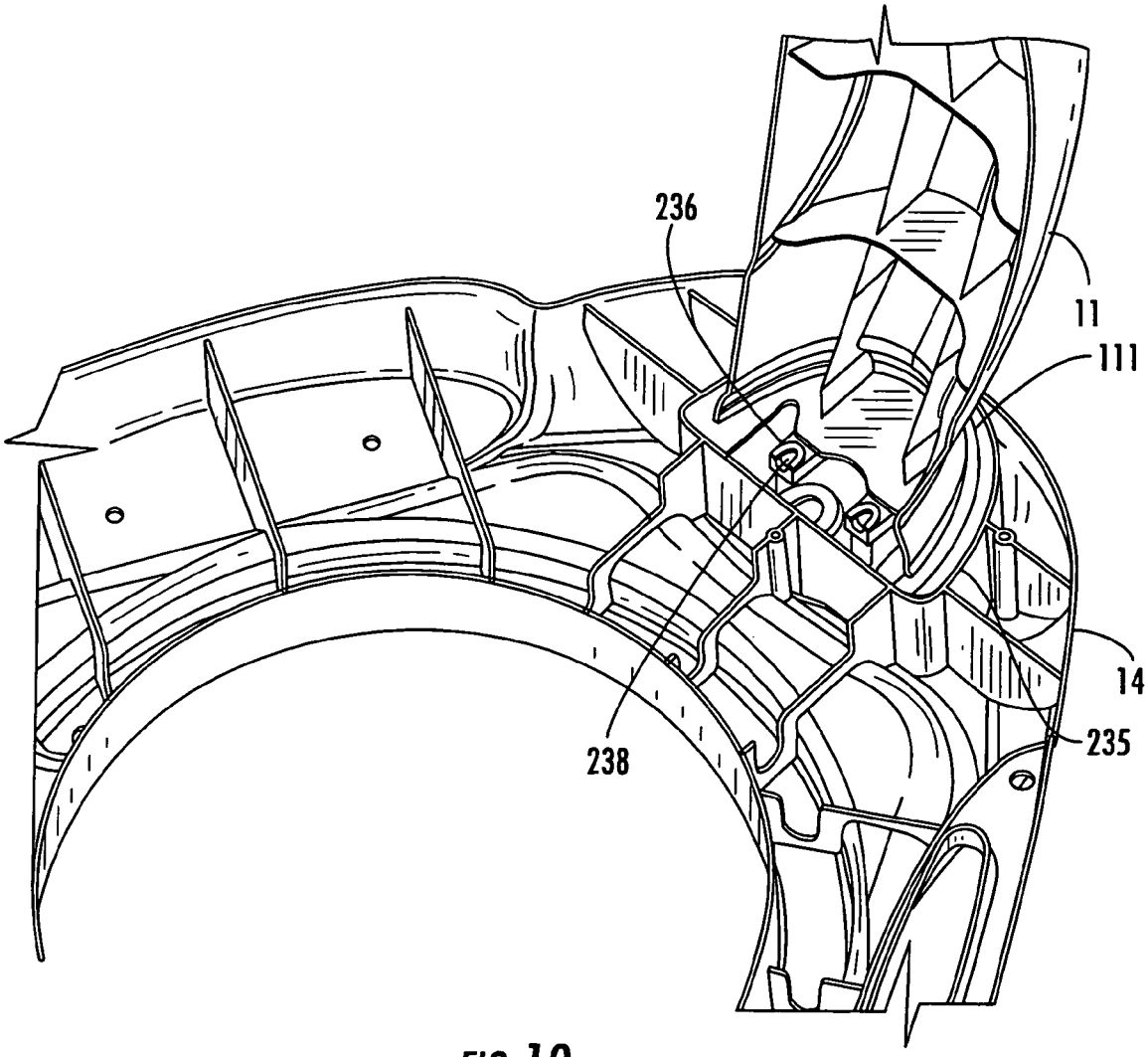
FIG. 10 shows a perspective view of a table and a leg according to one embodiment of the invention.

In another embodiment, the upper end 111 of each leg 11 includes a threaded hole that aligns with a threaded hole in the leg mounting portion 215, and a bolt or screw engages the threaded holes to secure the leg 11 to the mounting portion 215. For example, in the embodiment shown in FIG. 10, the leg mounting portion 215 defines a socket 235, and the upper end 111 of the leg 11 is positioned within the socket 235. The upper end 111 of the leg 11 further includes a pair of tabs 236 that each define an aperture, and each aperture aligns with and seats adjacent to a pair of cylindrical bosses 238 in the mounting portion 215. A screw, for example, is engaged through the apertures and the cylindrical bosses 238 to secure the leg 11 to the leg mounting portion 215.

In yet another embodiment (not shown), the upper end 111 of each leg 11 is configured to snap into the leg mounting portion 215. And, in an alternative embodiment, the leg mounting portions 215 are positioned on a lower surface of the activity table 14.

Figure 25:
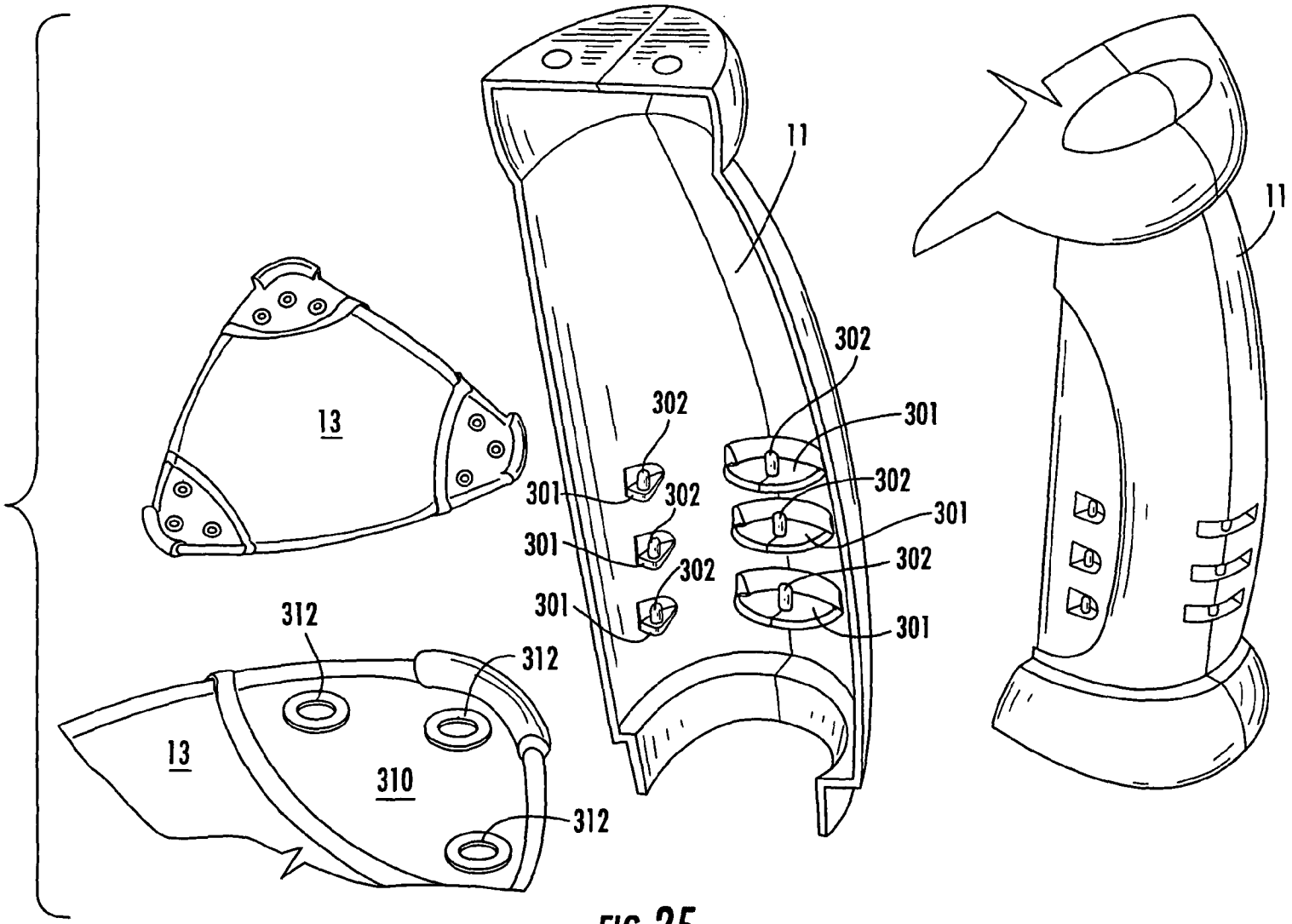
FIG. 25 shows a perspective view of a mounting portion in a leg according to one embodiment of the invention.
Figure 26:
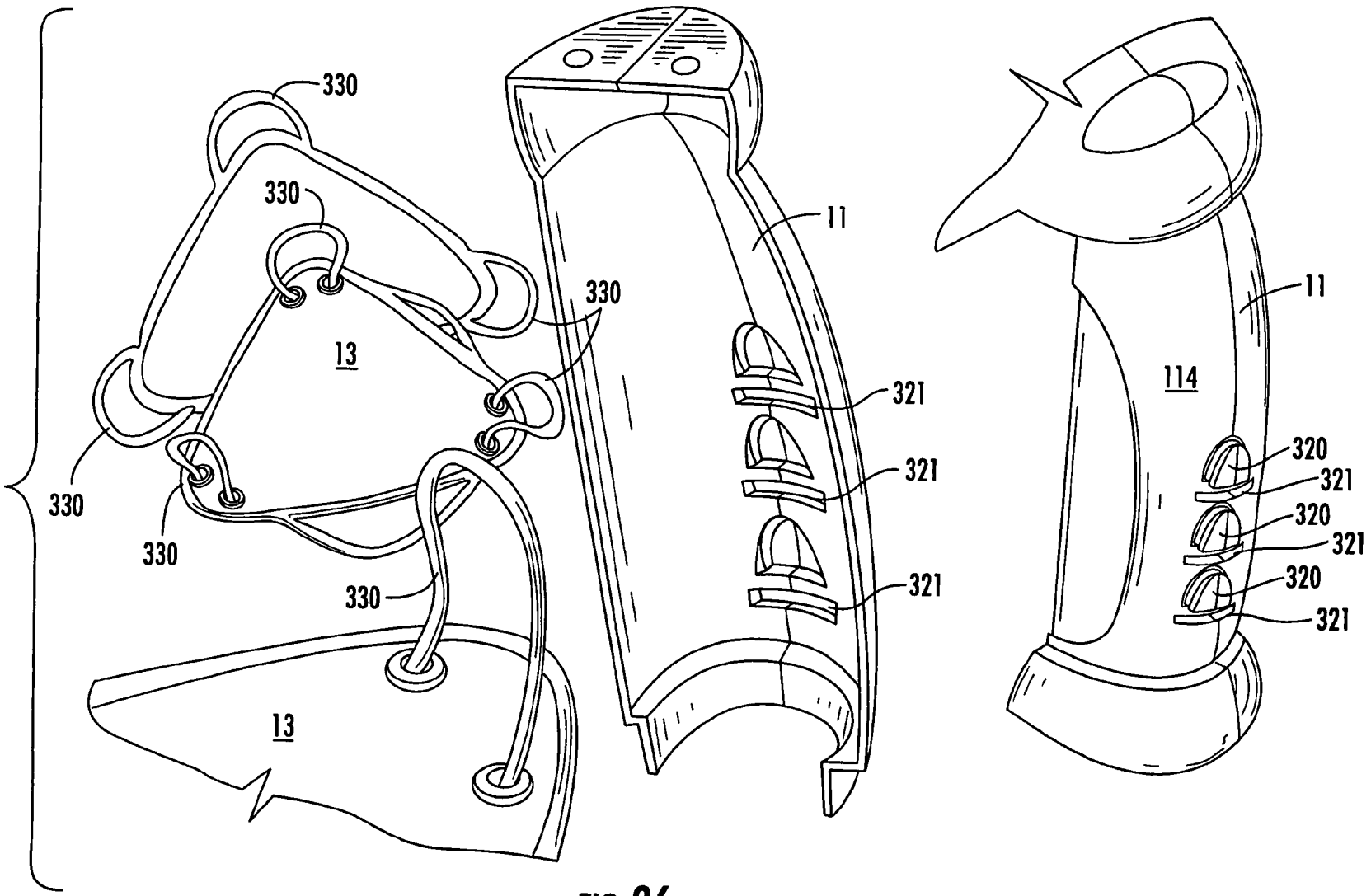
FIG. 26 shows a perspective view of a mounting portion in a leg according to one embodiment of the invention.

After the legs 11 are secured to the seat support ring 211 or the activity table 14 as described above, a resilient support surface 13 is suspended from one or more of the legs 11. The legs 11 include a plurality of mounting portions 112 to which the resilient support surface 13 can be mounted. Various embodiments of mounting portions 112 are envisioned for use with the present invention. For example, in the embodiment shown in FIG. 16, the mounting portions 112 are grooves, or recesses, defined on the legs 11 that receive elastic cords attached to the resilient support surface 13. In another example, as shown in FIGS. 17 through 24, the mounting portion 112 comprises slots or a series of slots that receive tabs attached to the resilient support surface 13 or pins with hook-shaped ends that couple the resilient support surface 13 to a leg 11. And, in yet another example, as shown in FIGS. 25 through 26, the mounting portions 112 are tabs or protrusions that receive elastic cords or engage mating holes or tabs coupled to the resilient support surface 13. Each of the types of mounting portions 112 is discussed in more detail below.

Figure 16:
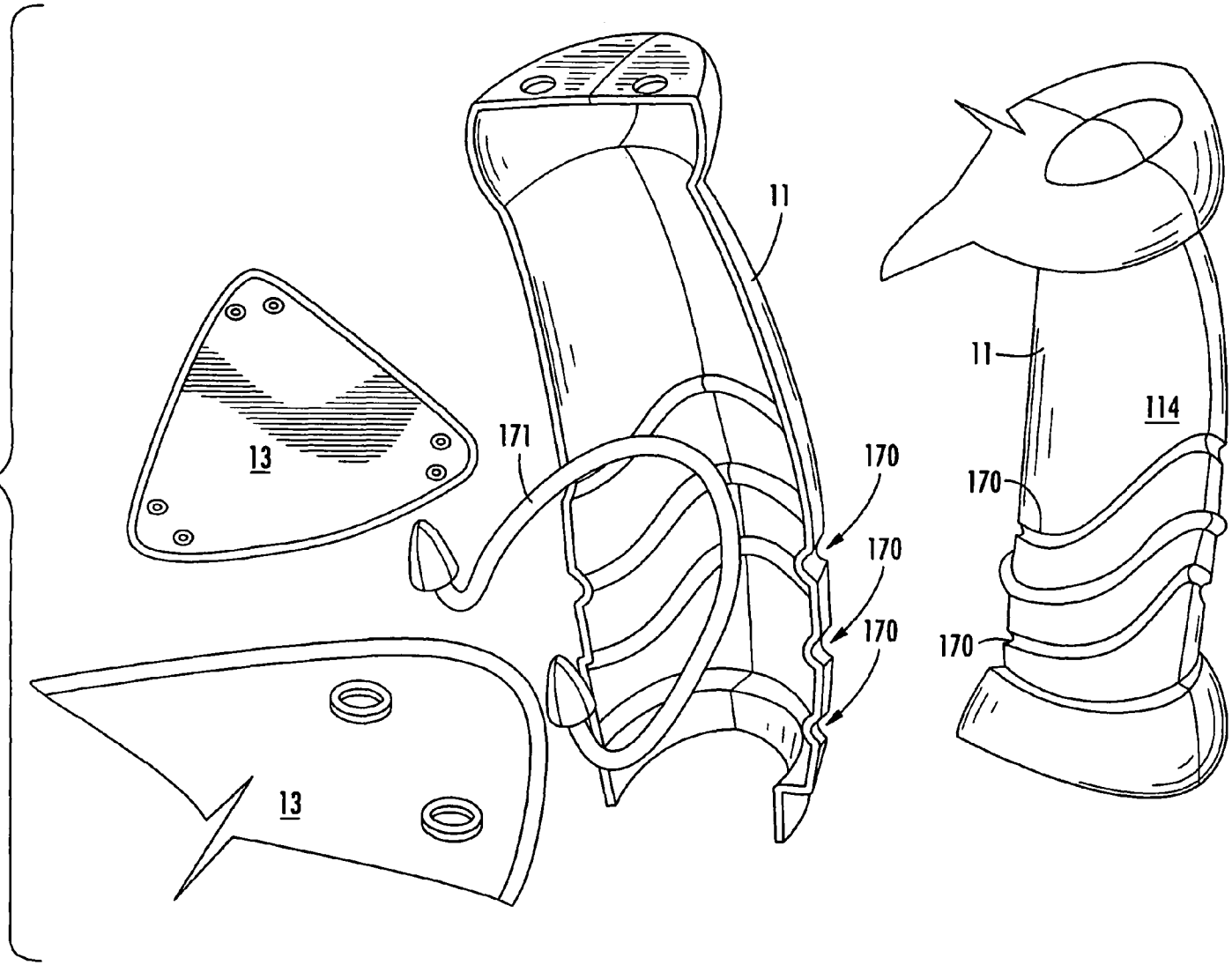
FIG. 16 shows a perspective view of a mounting portion in a leg according to one embodiment of the invention.

FIG. 16 illustrates an embodiment in which the mounting portion 112 comprises grooves 170 on an outer surface 114 of the legs 11. The grooves 170 are vertically aligned and follow an arcuate path on the outer surface 114 of the leg 11, which is a surface of the leg 11 that is not facing the center of the apparatus 10. An elastic cord 171 is secured to the resilient support surface 13 using grommets, molding, sewing, or other suitable fasteners. To suspend the resilient support surface 13 from the leg 11, the cord 171 is positioned around the outer surface 114 of the leg 11 and seated within a groove 170. To adjust the distance between the seat 12 and the resilient support surface 13, the cord can be seated a higher or lower groove 170. The grooves 170 prevent vertical movement of the cord 171 after the cord 171 is placed into the desired position. In a further embodiment (not shown), the grooves 170 further define a recess for receiving a tab that is attached to the cord 171. The tab makes the cord easier to grab and indicates the position of the cord.

Furthermore, if the legs 11 are positioned to extend downwardly and outwardly towards the floor, the tension in the cord 171 will increase as the cord 171 is moved to a lower groove 170, thus increasing the amount of energy required of a child within the apparatus 10 to move the resilient support surface 13 up and down. This effect is achieved regardless of the type of tension element present in the resilient support surface 13. Tension elements, such as flexible materials, springs, rubber cords, and rubber rings, are discussed above in relation to FIGS. 14 and 15 in the section entitled "Resilient Support Surface."

Figure 17:
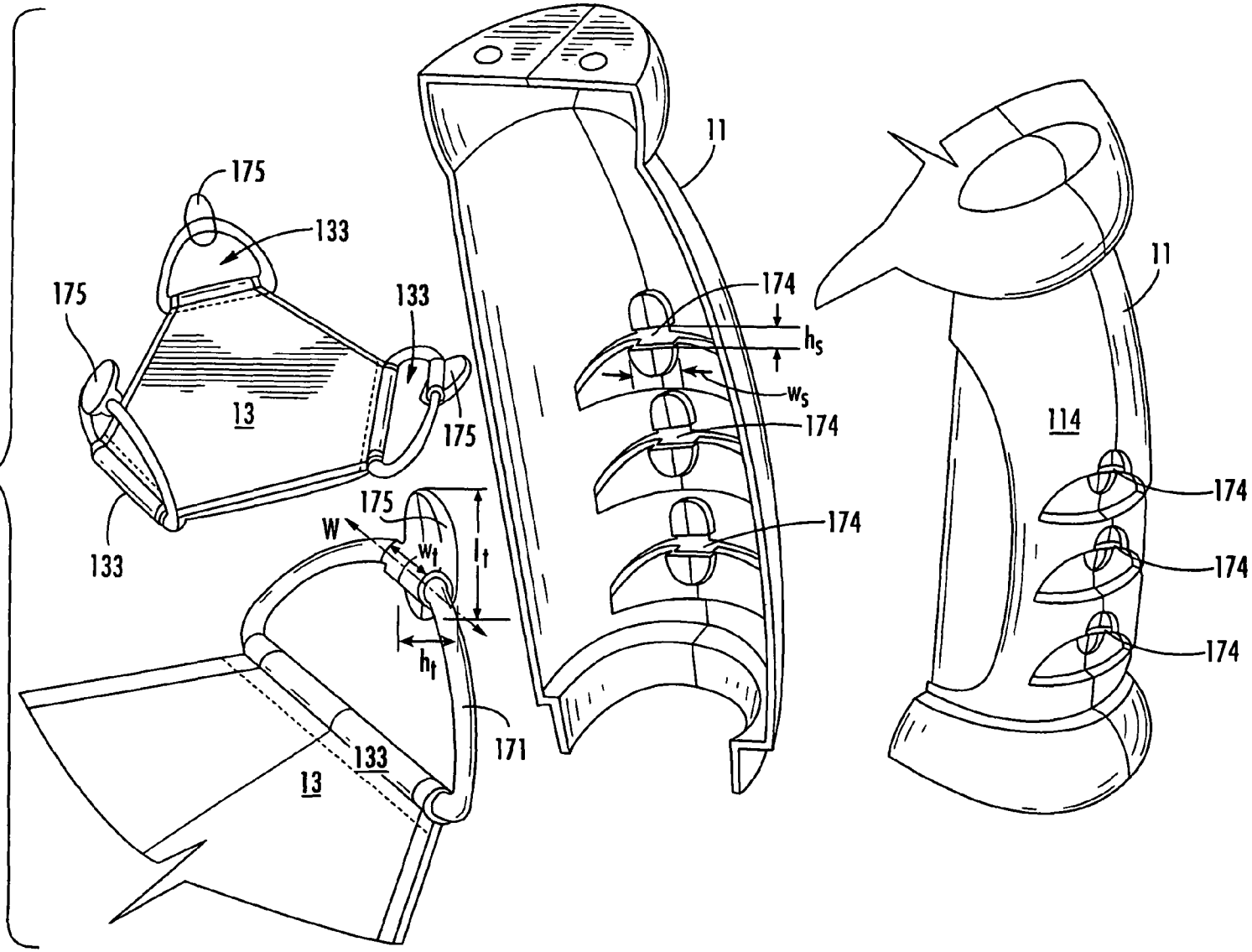
FIG. 17 shows a perspective view of a mounting portion in a leg according to one embodiment of the invention.
Figure 18:
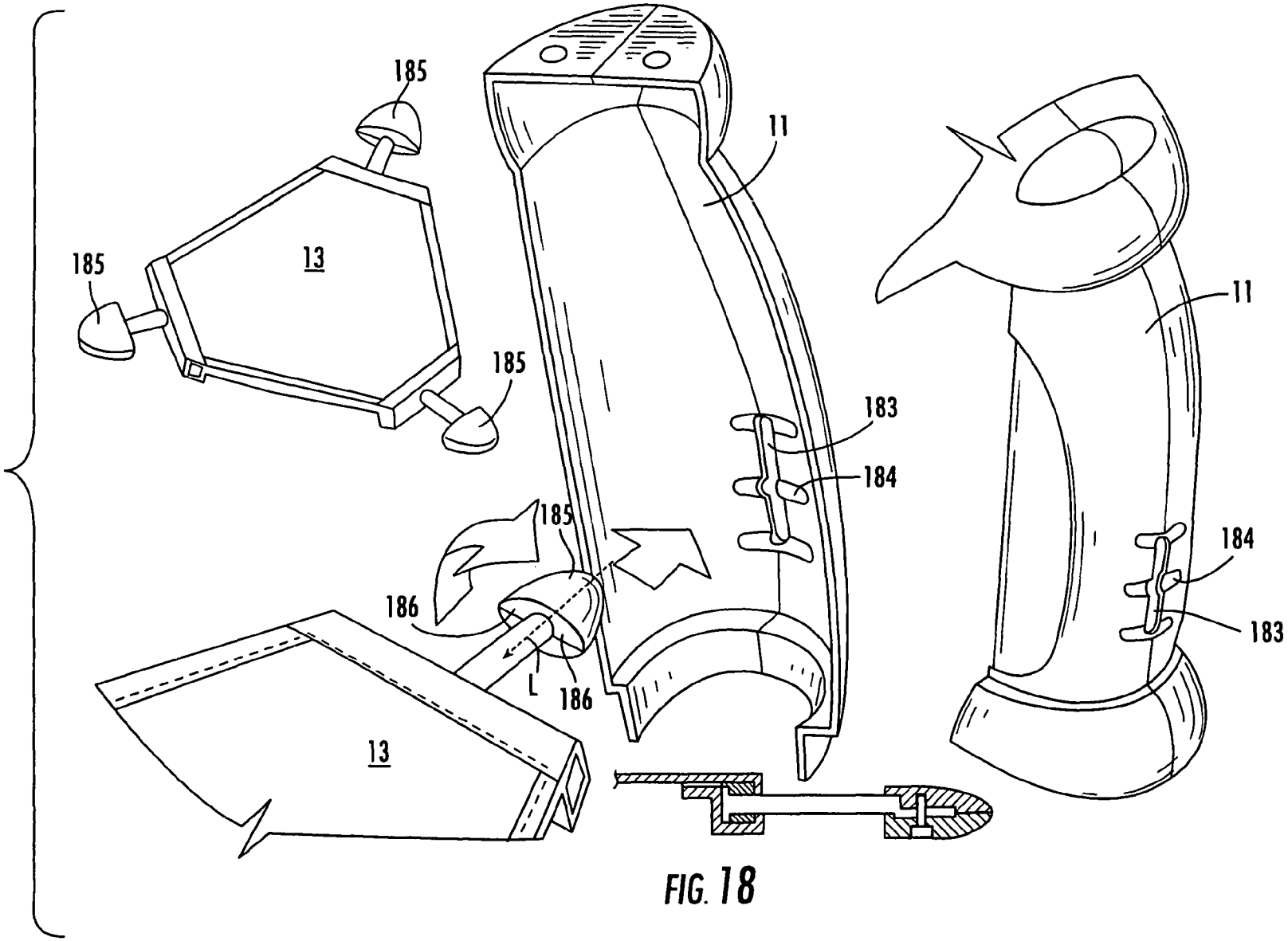
FIG. 18 shows a perspective view of a mounting portion in a leg according to one embodiment of the invention.

The mounting portion 112 shown in FIG. 17 is a plurality of vertically aligned, horizontally-oriented slots 174 adapted for receiving a tab 175 coupled to the resilient support surfaces 13. In particular, the tab 175 is attached to a cord 171, and the cord 171 is fastened to an outer periphery 133 of the resilient support surface 13. The tab 175 has a width $w_t$ that is smaller than the width $w_s$ of each slot 174, a height $h_t$ that is less than the height $h_s$ of each slot 174, and a length $l_t$ that is longer than the height $h_s$ of each slot 174. To insert the tab 175 into the slot 174, the tab 175 is rotated about an axis W extending through the width $w_t$ of the tab 175, pushed through the slot 174 in the direction towards the outer surface 114 of the leg 11, then rotated back about axis W such that the tab 175 seats against the outer surface 114 of the leg 11.

In an alternative embodiment (not shown), the tab 175 is coupled to the resilient support surface 13 without a cord 171. In yet another embodiment (not shown), two tabs 175 are coupled to the resilient support surface 13, and the two tabs 175 are mounted into a pair of slots 174 defined on the inner surface of each leg 11. Each pair of slots 174 are generally horizontally aligned, and the two or more pairs of slots 174 are vertically aligned on a leg 11 to provide the ability to adjust the distance between the seat 12 and the resilient support surface 13.

Like the embodiment described above in relation to FIG. 16, the distance of the resilient support surface 13 and the seat 12 can be adjusted by moving the tab 175 into a higher or lower horizontal slot 174. In addition, if the legs 11 are positioned downwardly and outwardly towards the floor, the tension in cords 171 attached to the tabs 175, the tabs 175, or in the resilient support surface 13 will adjust based on the distance between the resilient support surface 13 and the seat 12.

The mounting portions 112 shown in FIGS. 18 through 24 include a vertical slot and a plurality of horizontal grooves or slots stemming from the vertical slot. For example, in FIG. 18, an embodiment of the mounting portion 112 includes a vertical slot 183 that extends through the leg 11 and horizontal grooves 184 that are centered on and positioned along the length of the vertical slot 183 on the outer surface 114 of the leg 11. A tab 185 attached to the resilient support surface 13 has a width $w_t$ that is less than the height $h_s$ of the vertical slot 183 but greater than the width $w_s$ of the slot 183 and a height $h_t$ that is less than the width $w_s$ of the vertical slot 183. The tab 185 further includes an engaging surface 186 located on the surface of the tab 185 that is adjacent to the resilient support surface 13. To engage the tab 185 through the slot 183, the tab 185 is rotated about its lengthwise axis L, pushed through the slot 183, and then rotated back around axis L. The engaging surface 186 then engages a groove 184 on the outer surface 114 of the leg 11. To adjust the distance between the seat 12 and the resilient support surface 13, the tab 185 is moved to a higher or lower groove 184.

Figure 19:
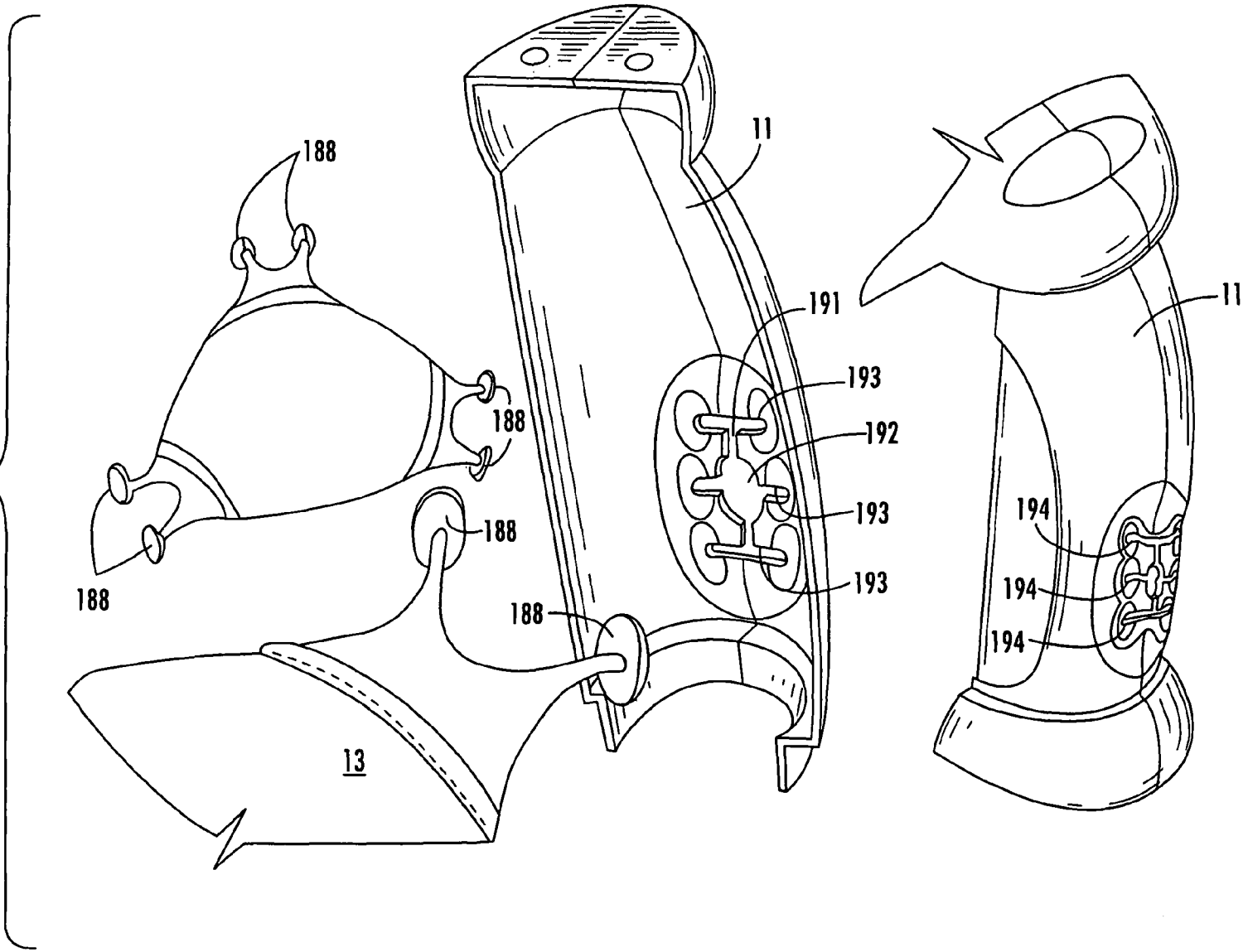
FIG. 19 shows a perspective view of a mounting portion in a leg according to one embodiment of the invention.

FIG. 19 illustrates another embodiment of a mounting portion 112 that includes one central vertical slot 191, an entry portion 192 on the vertical slot 191 for receiving tabs 188, and a plurality of horizontal slots 193 stemming from the vertical slot 191. The tabs 188 are secured to the mounting portion 112 by rotating the tabs 188, pushing them through the entry portion 192, and repositioning them back into an upright position. The distance between the seat 12 and the resilient support surface 13 is adjusted by moving the cords 171 or other material coupling the tabs 188 to the resilient support surface 13 up or down the vertical slot 191 and into the appropriate horizontal slots 193. When the tabs 188 are in the appropriate horizontal slot 193, the tabs 188 seat into grooves 194 positioned on the outer surface 114 of the leg 11 along the horizontal slots 193.

FIGS. 20 through 24 illustrate embodiments of mounting portions 112 that include vertical slots, such as the vertical slots described above in relation to FIGS. 18 and 19. However, instead of using tabs to mount the resilient support surface 13 to the legs 11, the embodiments in FIGS. 20 through 24 include pins that extend through the vertical slots and receive a connector portion, such as a cord, a grommet, or a ring, that is coupled to the resilient support surface 13.

Figure 20:
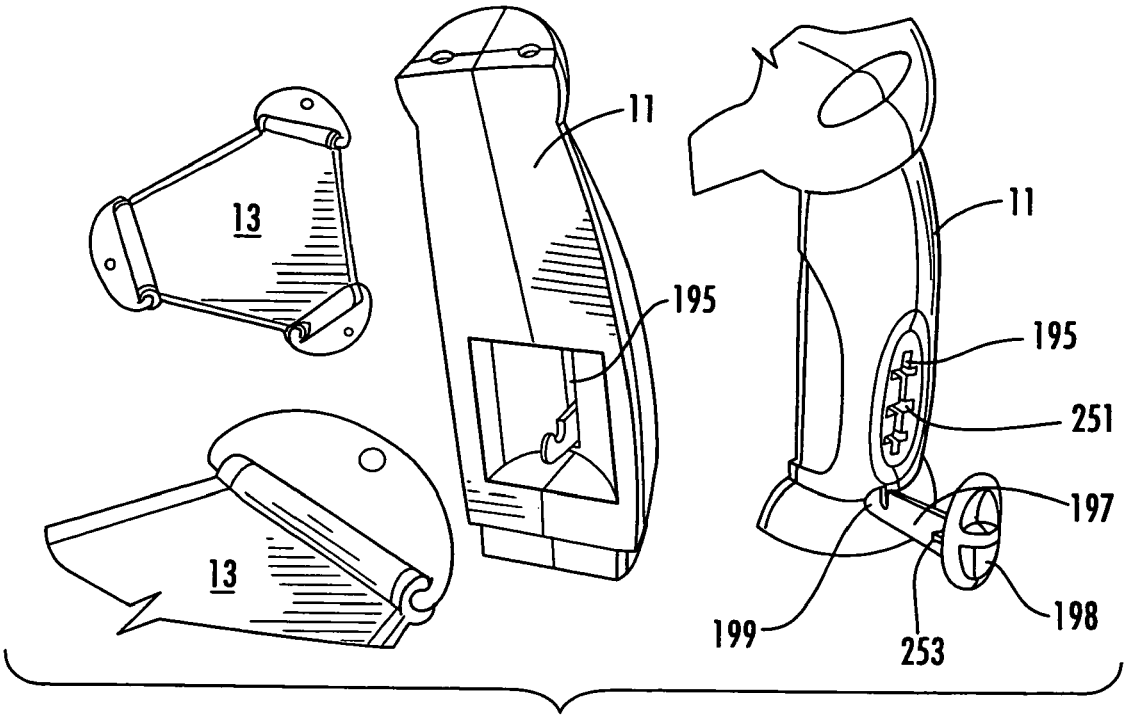
FIG. 20 shows a perspective view of a mounting portion in a leg according to one embodiment of the invention.

For example, FIG. 20 shows an embodiment of a mounting portion 112 that includes a vertical slot 195 that extends through the leg 11 and a plurality of horizontal slots 251 that are vertically aligned and extend from the vertical slot 195 and partially through the leg 11. A pin 197 has a head end 198, a hook end 199, and an elongated body between the head end 198 and the hook end 199. The head end 198 is wider than the vertical slot 195 extending through the leg 11, and the hook end 199 and the elongated body are thinner than the vertical slot 195. In addition, the pin 197 includes a vertical stop member 253 that extends horizontally across a portion of the elongated body adjacent to the head end 198. The vertical stop member 253 is dimensioned to fit within the horizontal slots 251.

To mount the resilient support surface 13 to the leg 11, the hook end 199 and elongated body are pushed through the vertical slot 195 from the outer surface 114 of the leg 11 towards the inner surface of the leg 11, and the vertical stop member 253 is engaged into one of the horizontal slots 251. The connector portion coupled to the resilient support surface 13 is engaged onto the hook end 199, and the tension element of the resilient support surface 13 pulls the head end 198 of the pin 197 into engagement with the outer surface 114 of the leg 11. To adjust the distance between the resilient support surface 13 and the seat 12, the head end 198 of the pin 197 is pulled outwardly relative to the outer surface 114 of the leg 11 until the vertical stop member 253 is disengaged from a horizontal slot 251, and the elongated body of the pin 197 is moved within the vertical slot 195 to the desired position. The vertical stop member 253 is then engaged into the corresponding horizontal slot 251.

In addition, FIG. 20 illustrates an embodiment of the mounting portion 112 in which the vertical slot 195 on the inner surface of the leg 11 is positioned within a recessed area 240. When the pin 197 is fully engaged in the vertical slot 195, the hook end 199 of the pin 197 and the portion the connector portion that engages the hook end 199 of the pin 197 are positioned within the recessed area 240, which prevents the child's foot from making contact with the hook end 199 of the pin 197.

Figure 21A:
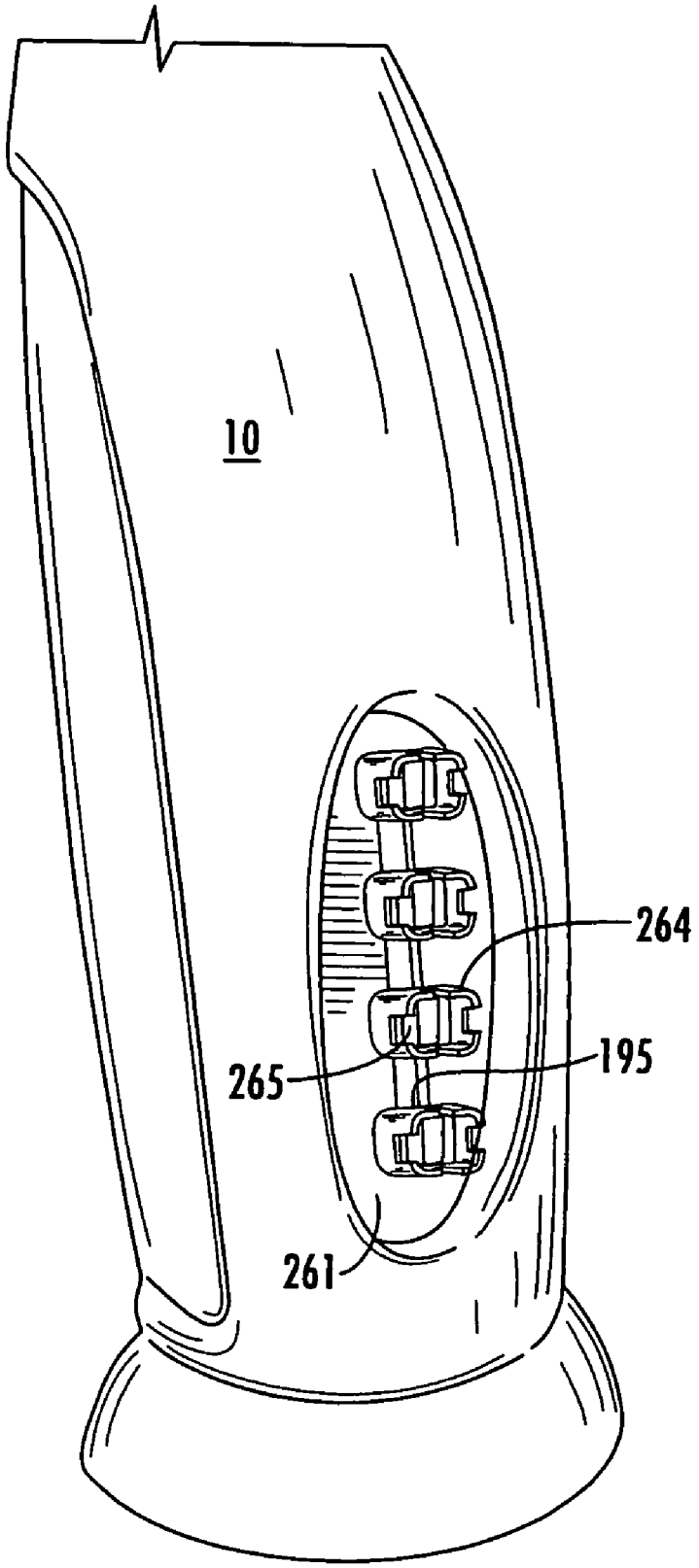
FIG. 21A shows a perspective view of a mounting portion in a leg according to one embodiment of the invention.
Figure 21B:
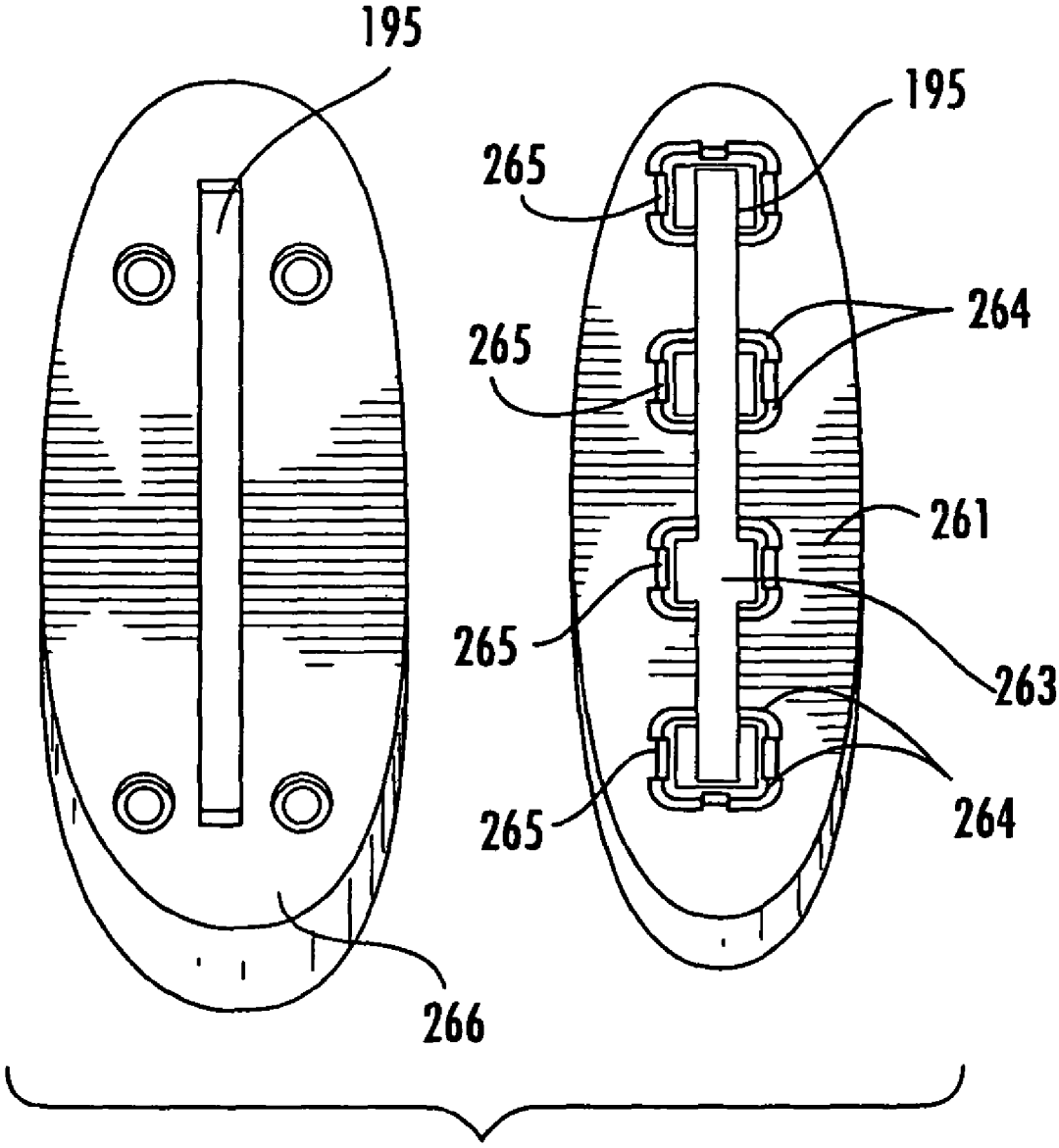
FIG. 21B shows a perspective view of a mounting portion in a leg according to one embodiment of the invention.
Figure 21C:
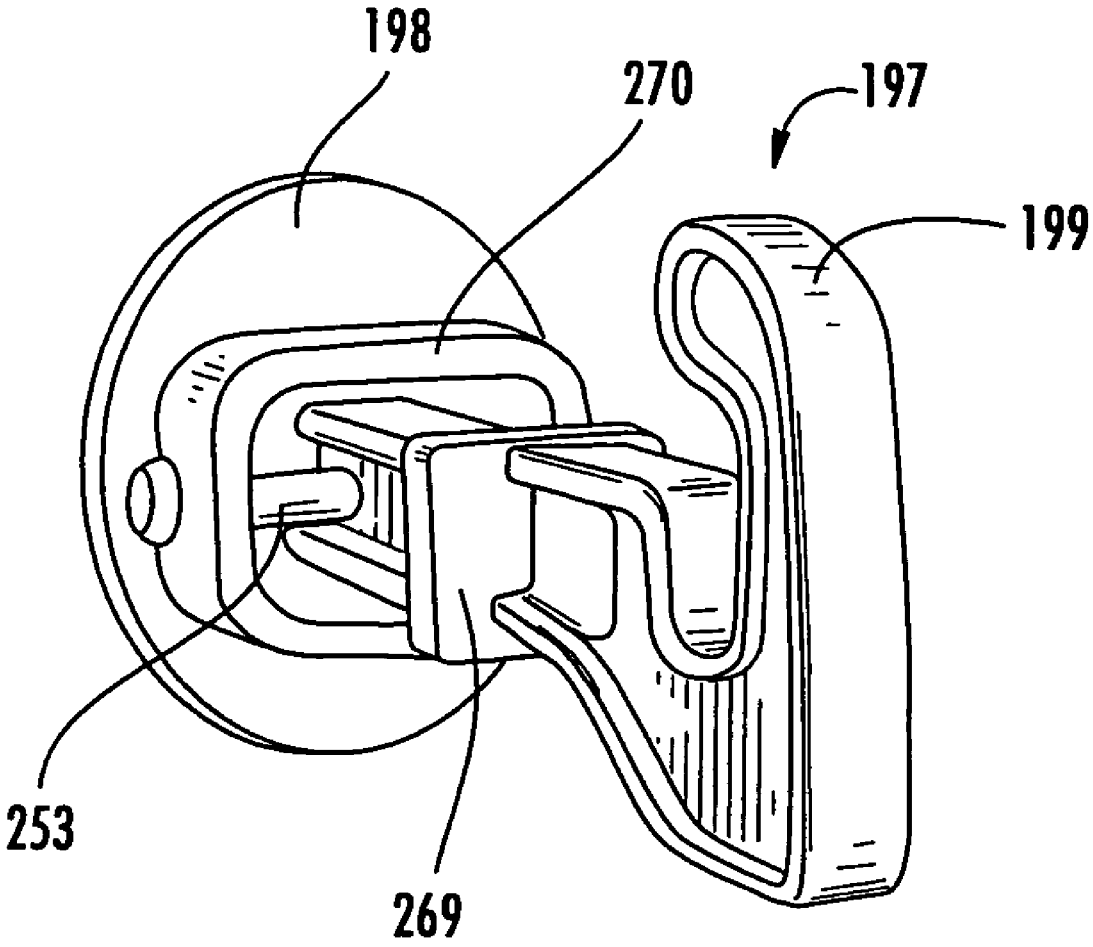
FIG. 21C shows a perspective view of a pin according to one embodiment of the invention.

FIGS. 21A, 21B, and 21C illustrate yet another embodiment of a mounting portion 112 that includes a vertical slot 195 that extends through the leg 11. In this embodiment, a plurality of plates 261, 266 are fixed adjacent to each other and mounted through the leg 11 to form the mounting portion 112. In particular, as shown in FIG. 21B, an outer plate 261 includes a vertical slot 195, an entry portion 263 that is wider than the vertical slot 195, and a plurality of protrusions 264 extending normally from the outer plate 261 and positioned along the vertical slot 195. Each protrusion 264 includes a depressed portion 265 that is horizontally aligned with another depressed portion 265 on the other side of the vertical slot 195. Adjacent to the outer plate 261 and to the inner surface of the leg 11 is an inner plate 266 that includes a vertical slot 195 that aligns with the vertical slot 195 in the outer plate 261.

The pin 197 described above in relation to FIG. 20 can be inserted through the vertical slots 195 in the plates 261, 266, and the vertical stop member 253 can be engaged into the depressed portions 265 of a pair of horizontally aligned protrusions 264 to prevent movement of the pin 197 in a vertical direction or in a horizontal direction towards the inner surface of the leg 11.

FIG. 21C illustrates a further embodiment of a pin 197 that can be engaged into the above-described mounting portion 112. The pin 197 includes a vertical stop member 253 adjacent to the head end 198 and an inner horizontal stop member 269 between the vertical stop member 253 and the hook end 199. The inner horizontal stop member 269 is dimensioned slightly smaller than the entry portion 263 in the outer plate 261. To mount the pin 197 into the mounting portion 112, the hook end 199 and inner horizontal stop member 269 are inserted through the entry portion 263 of the outer plate 261, and the hook end 199 is further inserted through the vertical slot 195 of the inner plate 266. The inner horizontal stop member 269 does not extend through the vertical slot 195 of the inner plate 266 as the width of the stop member 269 is dimensioned to be wider than the vertical slot 195. The inner horizontal stop member 269 prevents the unintentional removal of the pin 197 from the leg 11.

In a further embodiment, as shown in FIG. 21C, the pin 197 includes an outer stop member 270 that is positioned adjacent to the head end 198 and further prevents the pin 197 from moving through the vertical slot 195 past the outer surface 114 of the leg 11 and from moving vertically within the slot 195. The outer stop member 270 extends normally from the head end 198 towards the hook end 197 and has an inner diameter (or width and length) that is slightly larger than the outer diameter as measured across two horizontally adjacent protrusions 264 on the outer plate 261. The vertical stop member 253 and the outer stop member 270 are aligned with a pair of horizontally-aligned protrusions 264 on the outer plate 261. The vertical stop member 253 is positioned within the depressed portions 265 of each protrusion 264, and the outer stop member 270 is positioned to fit around the protrusions 264 and seat against a face of the outer plate 261. To move the pin 197 up or down, the pin 197 is pulled outwardly from the outer plate 261 until the outer stop member 270 clears the protrusions 264, while keeping the inner horizontal stop member 269 intermediate the outer 261 and inner plate 266. The pin 197 is then moved up or down in the vertical slot 195 to the desired position, and the vertical stop member 253 and the outer stop member 270 are engaged into a pair of horizontally aligned protrusions 264, as described above.

Figure 22:
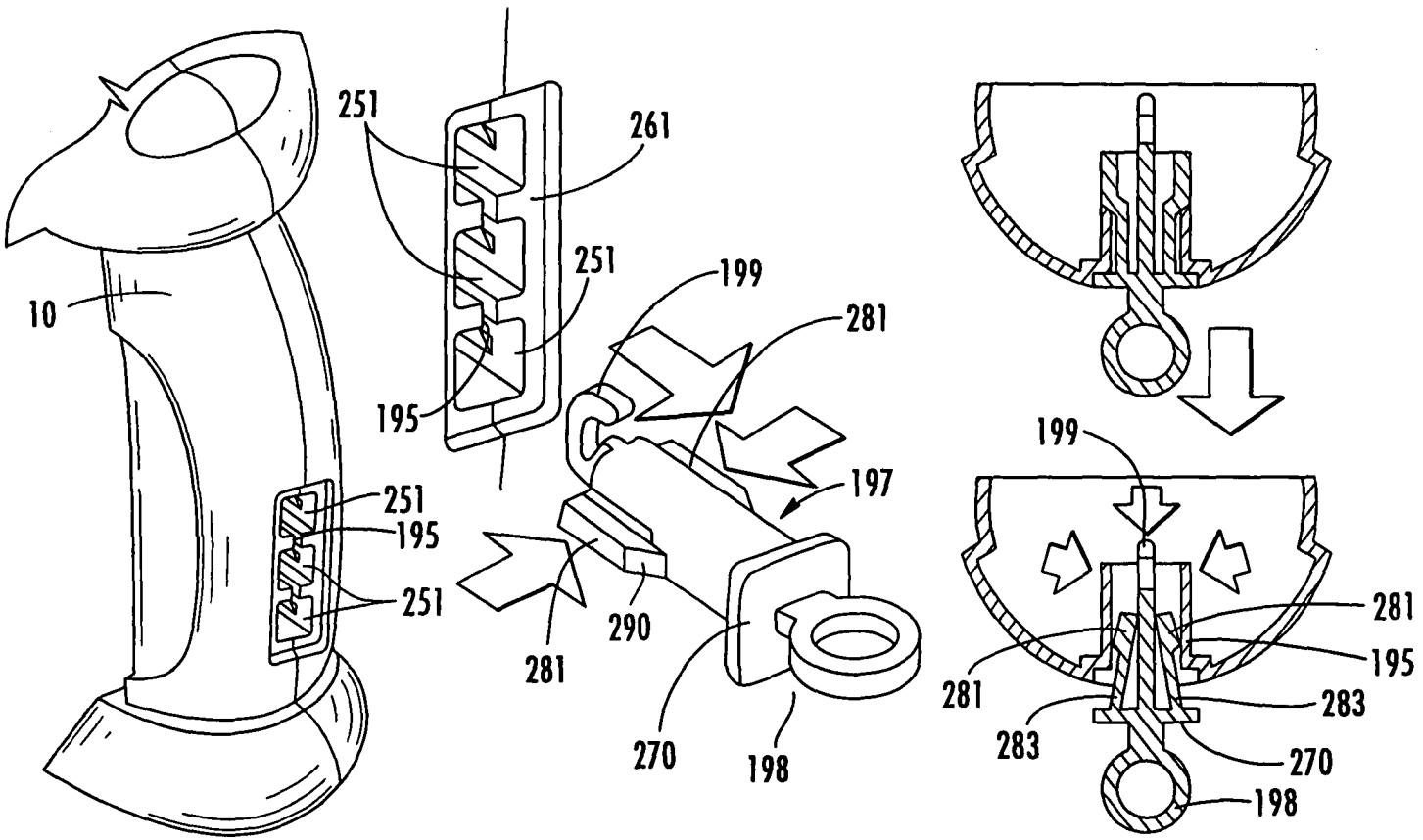
FIG. 22 shows a perspective view of a mounting portion in a leg according to one embodiment of the invention.

FIG. 22 shows an embodiment of a pin 197 having a biased inner horizontal stop member 269. In this embodiment, two fingers 283 on opposite sides of the elongated body of the pin 197 extend from the head end 198 past the outer stop member 270 towards the hook end 199. Ribs 281 extend from the ends of the fingers 283 near the hook end 199, and each of the ribs 283 has a ramped portion 290 that gradually extends outwardly from the finger 283 in the direction towards the end of the finger 283 adjacent to the hook end 199. To mount the pin 197 within the vertical slot 195, the fingers 283 are pushed inwardly towards the elongated body of the pin 197 such that the width of the pin 197 is less than the width of the vertical slot 195. When the ribs 281 are located between the inner 266 and outer plates 261, the fingers 283 are released and bias the ribs 281 outwardly, preventing the unintentional removal of the pin 197 from the mounting portion 112. To remove the pin 197 from the mounting portion 112, the pin 197 is pulled in an outward direction from the leg 11 and the inner surface of the outer plate 261 adjacent to the vertical slot 195 forces the ramped portion 290 of the ribs 281 inwardly, allowing the pin 197 to be removed.

Figure 23:
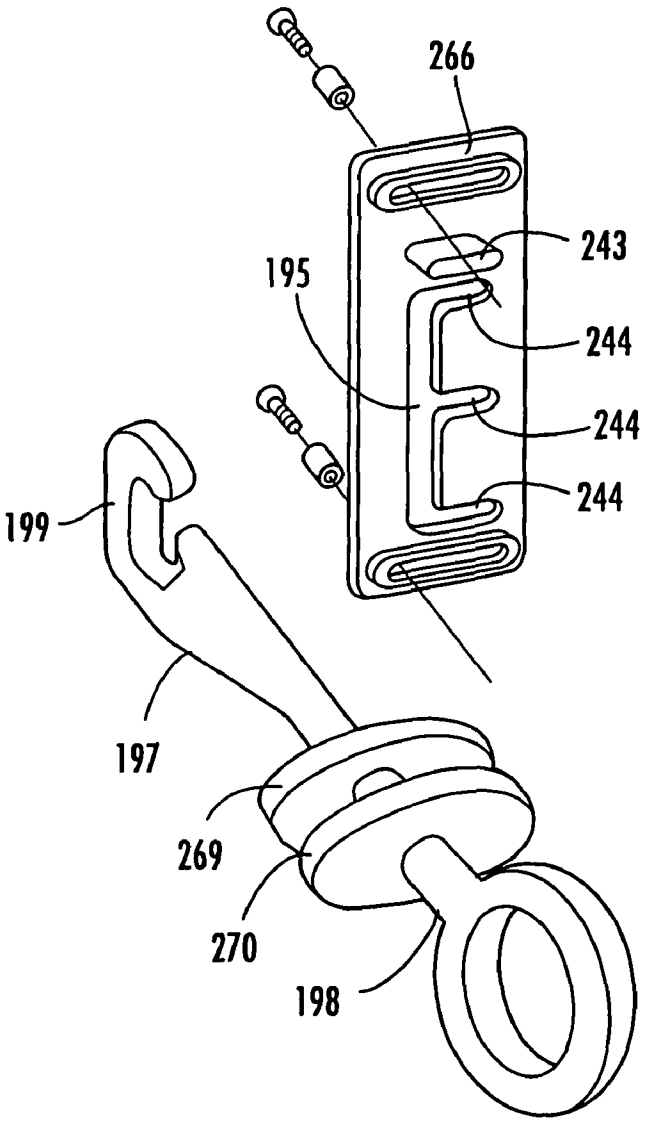
FIG. 23 shows a perspective view of a mounting portion in a leg according to one embodiment of the invention.
Figure 23:
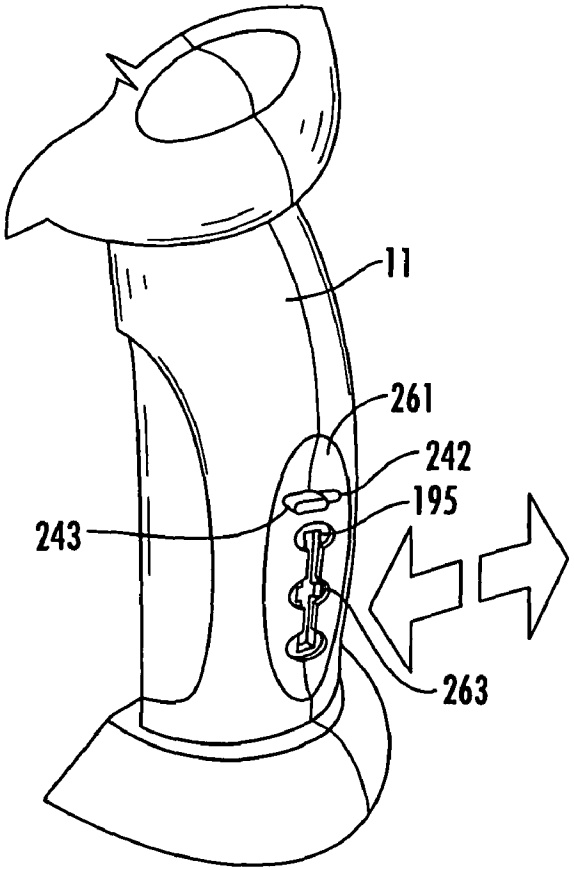

FIG. 23 illustrates an additional embodiment of a mounting portion 112 that includes an outer plate 261 and an inner plate 266. The outer plate 261 defines a vertical slot 195, a plurality of horizontal grooves 196 extending from the vertical slot 195, and an aperture 242 for receiving a protrusion 243 from the inner plate 266. The vertical slot 195 further includes an entry portion 263 for receiving an inner horizontal stop member 269 on a pin 197. The inner plate 266 includes a vertical slot 195, a plurality of horizontal slots 244 extending to one side of the vertical slot 195, and a protrusion 243 extending from the inner plate 266 through the aperture 242 on the outer plate 261. To mount the pin 197 within the mounting portion 112, the protrusion 243 is urged horizontally to align the vertical slot 195 on the inner plate 266 with the vertical slot 195 on the outer plate 261, and the hook end 199 of the pin 197 is inserted through the entry portion 263 in the outer plate 261 and moved to the desired vertical position. When the pin 197 is in the desired position, the protrusion 243 is urged horizontally in the opposite direction as before to align the horizontal slots 244 on the inner plate 266 with the vertical slot 195 on the outer plate 261, which prevents vertical movement of the pin 197.

Figure 24A:
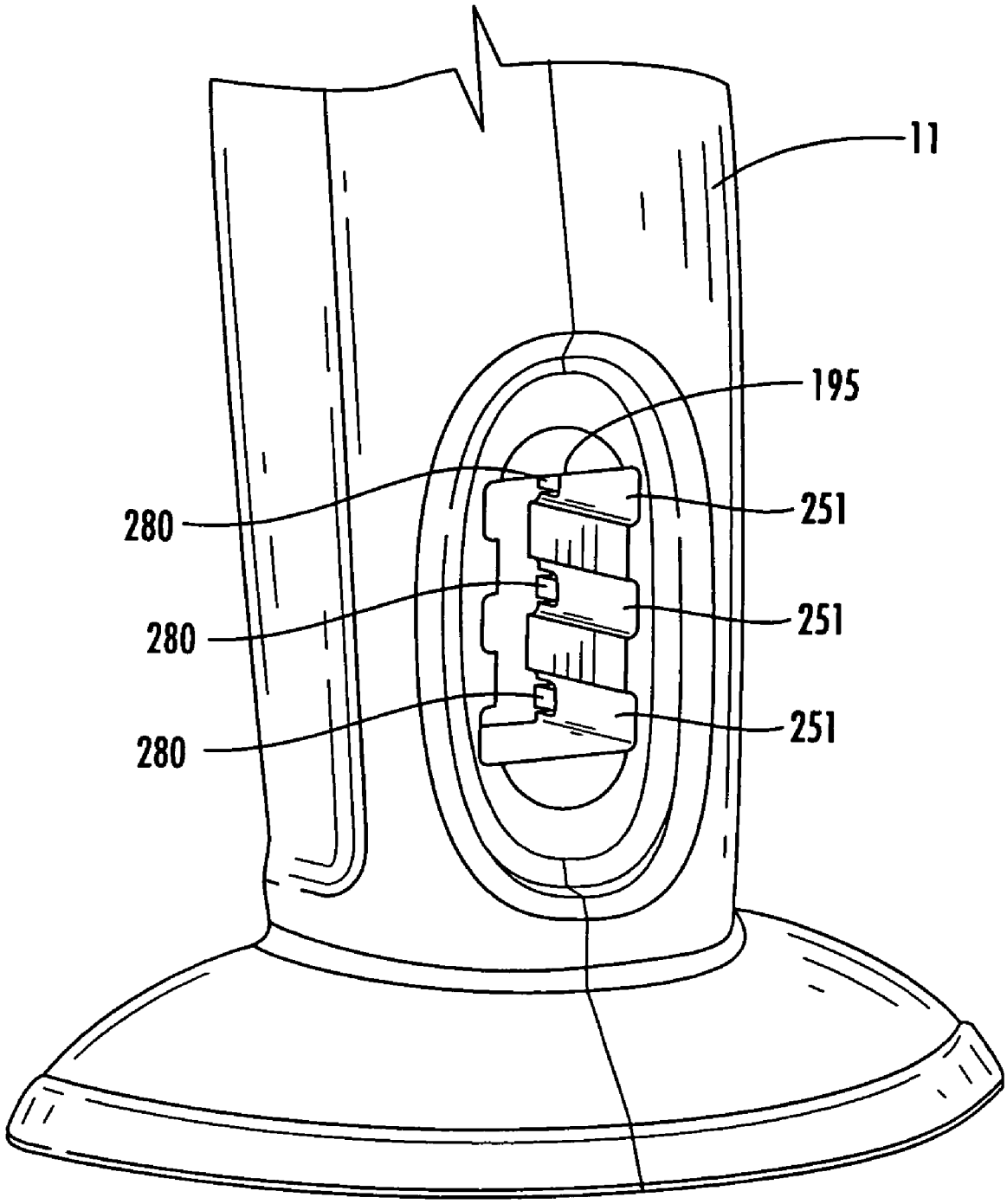
FIG. 24A shows a perspective view of a mounting portion in a leg according to one embodiment of the invention.
Figure 24B:
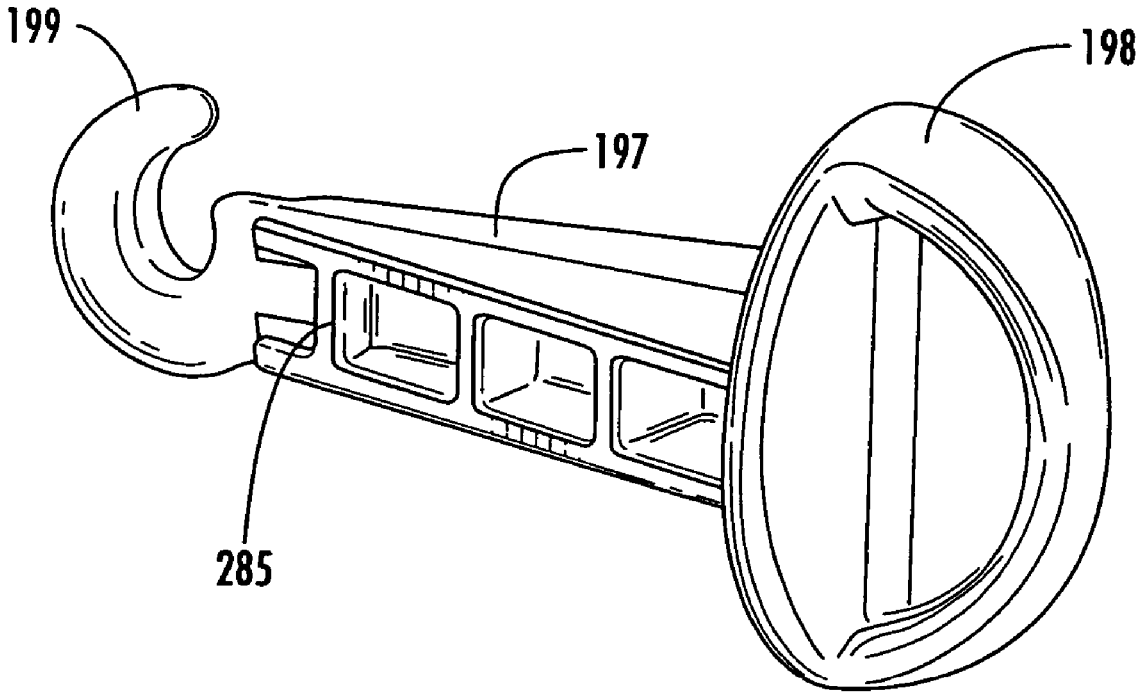
FIG. 24B shows a perspective view of a pin according to one embodiment of the invention.

FIGS. 24A and 24B illustrate another embodiment of a mounting portion 112 that includes horizontal slots 251 extending from a vertical slot 195. However, as shown in FIG. 24A, the horizontal slots 251 extend all the way through the leg 12, and the width of the horizontal slots 251 gradually decreases from the outer surface 114 of the leg 12 towards the inner surface of the leg 12 at a certain angle. A cantilevered latch 280 extends from a side of each horizontal slot 251 adjacent the inner surface of the leg 12 towards the vertical slot 195. The pin 197 shown in FIG. 24B further includes a horizontal rib 285 that extends at least partially through the body of the pin 197 adjacent to the hook end 199, and the pin 197 has a width that gradually decreases from the head end 198 towards the hook end 199 at substantially the same angle as the horizontal slots 251. When the pin 197 is pushed through one of the horizontal slots 251, the rib 285 of the pin 197 engages the cantilevered latch 280, causing the latch 280 to deflect away from the inner surface of the leg 12 towards the center of the apparatus 10. Once the rib 285 moves past the cantilevered latch 280, the cantilevered latch 280 returns to its initial position such that it seats adjacent the rib 285 and prevents unintentional movement of the pin 197 in a horizontal direction. To remove the pin 197 or move it to another horizontal slot 251, the pin 197 is pulled outwardly from the leg 12 with enough force to deflect the cantilevered latch 280 towards the outer surface 114 of the leg 12 and move the rib 285 past the latch 280.

In another embodiment of a mounting portion 112, which is shown in FIG. 25, the mounting portion 112 includes a tab or protrusion onto which a connector attached to the resilient support surface 13 can be mounted. The inner surface of each leg 11 includes a generally horizontal flange 301 extending normally from the inner surface of the leg 11. One or more protrusions 302 extend normally from the flange 301 in an upward direction. A tab 310 attached to the resilient support surface 13 has tabs 310 that include one or more grommets 312. The grommets 312 receive the protrusions 302, which may be shaped like hooks, preventing the horizontal movement of the resilient support surface 13 relative to the legs 11. In an alternative embodiment (not shown), the tabs 310 include protrusions 313 extending from the lower surface of the tabs 310, and the horizontal flange 301 extending from each leg 11 includes depressed portions 303 for receiving the protrusions 313. In other embodiments (not shown), the tabs 310 may include cords that extend from the tabs 310 to wrap around the protrusions 302 or flanges that extend downwardly from the tabs 310 to engage the protrusions 302.

FIG. 26 illustrates another embodiment in which the inner surface of the leg 11 includes tabs 320 that extend upwardly and outwardly from the inner surface. Cords 330 attached to the resilient support surface 13 are positioned between the tabs 320 and the inner surface by moving them downwardly behind the tab 320. The tabs 320 prevent the cords 330 from moving in a horizontal direction away from the legs 11 or a vertical direction relative to the legs 11. Alternatively, which is not shown, the tabs 320 are located on the outer surface 114 of the leg 11, and the cords 330 are inserted into and pulled through a horizontal slot 321 positioned below the tab 320 and positioned between the tab 320 and the outer surface 114. In yet another embodiment in which the tabs 320 are positioned on the outer surface 114 of the leg 11 (not shown), the cords 330 can be wrapped around the outer surface 114 and positioned between the tabs 320 and the outer surface 114 such that the body of the leg 11 prevents the movement of the cord 330 away from the leg 11 and the tab 320 prevents the movement of the cord 330 in a vertical direction.

Furthermore, in any of the embodiments described above in relation to FIGS. 16 through 26, if the legs 11 are positioned downwardly and outwardly towards the floor, the tension in cords, in the connector portion, or in the resilient support surface will increase as the distance between the resilient support surface 13 and the seat 12 increases and will decrease as the distance decreases.

Activity Table

As mentioned above, the apparatus 10 may further include an activity table 14. FIGS. 1 through 4 illustrate an embodiment of an activity table 14 that surrounds the seat 12 of the exercise apparatus 10 and includes an upper surface 141 configured for receiving and supporting one or more children's activity items 142. As shown in FIG. 1, the upper surface 141 of the activity table 14 includes depressed receptacles 144 that are dimensioned to receive activity items 142 that have engagement portions for mating with the depressed receptacles 144. For example, the upper surface 141 of the table 14 shown in FIG. 1 includes three receptacles 144.

In a further embodiment, each receptacle 144 can be configured to receive a different type of activity item 142, such as an electronic piano, mechanical, or physically interactive toys, and a tray for holding food. A piano is a term used to describe a mechanical or electrical activity item that includes keys or buttons for the child to push, and in response to the child pushing the keys or buttons, music, voice, or other sounds are played. Mechanical toys can include bead-chasers, spring loaded toys that vibrate back and forth when pulled or pushed, toys mounted on an axis that spin when force is applied to the toy. Other activity items 142 that can be mounted to the table 14 or onto handle, or toy, bars 143 that are mounted to the table 14 include bead chasers, flexible mirrors, see-saw clickers, and stalk toys, such as rattle balls, water or gel-filled teething toys, mirrors, and squeakers.

As mentioned above and shown in FIG. 7, one embodiment of the activity table 14 is integrally formed with the seat support ring 211. The outer wall 214 of the seat support ring 211 extends downwardly from the outer periphery of the annular horizontal engagement surface 212. The activity table 14 defines a horizontal annular groove 145 that has a central vertical axis C, which is coaxial with the central vertical axis B of the seat support ring 211, and includes a lower horizontal surface 146. The wall 214 of the seat support ring 211 intersects the lower horizontal surface 146, serving as an inner wall of the horizontal annular groove 145. The groove 145 is useful for containing any food or drink spills that may occur while a child is positioned within the exercise apparatus 10, which facilitates cleaning up the spills. In an alternative embodiment (not shown), the table 14 does not include a groove 145 and the wall 214 intersects with the upper surface 141 of the activity table 14.

In another alternative embodiment, the seat support ring 211 and the activity table 14 are separate. As shown in FIG. 8, an annular groove 147 is defined in the activity table 14 by an outer vertical wall 148 that extends downwardly from the upper surface 141 of the activity table 14, a horizontal surface 149 that extends horizontally towards a central vertical axis D of the groove, and an inner vertical wall 150 that extends upwardly from the horizontal surface 149 of the groove 147. The outer wall 214 of the seat support ring 211 extends downwardly from the annular horizontal engagement surface 212, and the inner diameter of the outer wall 214 is approximately the same as the outer diameter of the inner wall 150 of the annular groove 147. To couple the seat support ring 211 to the activity table 14, the outer wall 214 of the seat support ring 211 is positioned adjacent to the inner wall 150 of the groove 147 and the central vertical axis D of the groove 147 is coaxial with the central vertical axis B of the seat support ring 211.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A children's exercise apparatus for providing exercise functionality for a small child, said apparatus comprising:

one or more legs supported on a floor;

a seat rigidly and directly supported by the legs and being structured to support the child while allowing the child's legs to extend downwardly below the seat; and a resilient support surface suspended generally horizontally from at least one of the legs and positioned vertically between the seat and the floor, said resilient support surface having a resiliency that is adapted for allowing the child to bounce vertically by pushing its legs downwardly against the resilient support surface.

2. The apparatus of claim 1 further comprising at least one element under tension to provide the resiliency for the resilient support surface, and wherein at least one leg defines a mounting portion, said mounting portion being adapted for securing said resilient support surface to said leg at a distance below said seat.

3. The apparatus of claim 2, wherein said mounting portion defines a plurality of vertical stops such that a distance between said seat and said resilient support surface is increased by coupling said resilient support surface to a lower vertical stop and said distance is decreased by coupling the resilient support surface to a higher vertical stop.

4. The apparatus of claim 3, wherein said one or more legs are positioned to extend outwardly and downwardly from the seat to the floor such that the tension of the element increases when the resilient support surface is secured closer to the floor and the tension of the element decreases when the resilient support surface is secured closer to the seat.

5. The apparatus of claim 3 wherein said plurality of vertical stops includes a plurality of grooves defined in an outer surface of one of said one or more legs, each of said grooves being adapted for receiving a resilient cord and preventing said resilient cord from moving vertically.

6. The apparatus of claim 3 wherein said plurality of vertical stops includes a plurality of horizontal slots, each of said horizontal slots adapted for receiving a tab coupled to said resilient support surface and preventing said tab from moving vertically.

7. The apparatus of claim 3 wherein said plurality of vertical stops includes a plurality of horizontal slots extending from an elongated vertical slot in each of said one or more legs, said vertical slot having a certain width, and said apparatus further comprising a pin adapted for selectively engaging said vertical slot and said horizontal slots and having an elongated body with a width that is less than the width of the vertical slot, a horizontal stop member, and a vertical stop member, wherein said horizontal stop member has a width greater than said width of said vertical slot to prevent said horizontal stop member from passing through said vertical slot and said vertical stop member is adapted for selectively engaging said horizontal slots, preventing said pin from moving vertically.

8. The apparatus of claim 7 wherein:

each of said plurality of horizontal slots has a width that gradually decreases from an outer surface of said leg to an inner surface of said leg at an angle;

each of said horizontal slots further includes a cantilevered latch extending adjacent said inner surface of said leg towards said vertical slot, said cantilevered latch adapted for seating adjacent a rib extending at least partially through said pin; and said elongated body of said pin has a width that gradually decreases from said head end towards said hook end at substantially the same angle as said horizontal slots and said rib is positioned adjacent said hook end.

9. The apparatus of claim 2 wherein said resilient support surface comprises a flexible material.

10. The apparatus of claim 2 wherein said resilient support surface comprises a middle portion comprising a rigid material and a peripheral portion comprising a resilient material.

11. The apparatus of claim 2 wherein said resilient support surface comprises a rigid material and a plurality of molded rubber springs attached along the periphery of said resilient support surface.

12. The apparatus of claim 1 wherein:

each of said legs defines an elongated vertical slot with a certain width and a plurality of projections extending normally from said legs, said projections being vertically aligned adjacent said vertical slot, and said apparatus further comprising:

a pin adapted for selectively engaging said vertical slot and at least a portion of each of said projections, said pin having an elongated body with a width that is less than the width of the vertical slot, a vertical stop member, and a horizontal stop member, wherein said vertical stop member is positioned along the elongated body and is adapted for engaging the projections extending from said legs, preventing said pin from moving up or down within said vertical slot, and wherein said horizontal stop member has a width greater than said width of said vertical slots, preventing said horizontal stop member from passing through said vertical slot.

13. The apparatus of claim 1, said resilient support surface further comprising an contact sensor and an electronic sound unit, wherein said electronic sound unit is adapted for emitting a sound when said contact sensor senses movement of the resilient support surface.

14. The apparatus of claim 1 further comprising an activity table at least partially surrounding said seat, wherein said activity table is adapted for receiving one or more children's activity items.

15. The apparatus of claim 1 wherein said seat comprises:

a seat support ring having a first central vertical axis and an annular horizontal engagement surface extending towards said first central vertical axis; and a seat carrier ring having a second central vertical axis, a inner wall, an outer wall, and a lower surface, said lower surface positioned between said inner wall and said outer wall;

wherein said lower surface of said seat carrier ring is positioned adjacent said horizontal engagement surface of said seat support ring such that said central axis of said seat support ring is coaxial with said central axis of said seat carrier ring and said seat carrier ring can rotate about said central axes independently of said seat support ring.

16. The apparatus of claim 15 further comprising a fabric sling for receiving a child, said sling having a top portion and a bottom portion, wherein said bottom portion defines a pair of holes for receiving a child's legs and said top portion includes one or more fasteners for engaging one or more fastener receiving portions positioned on the seat carrier ring.

17. The apparatus of claim 15 wherein said lower surface of said seat carrier ring comprises a plurality of ribs positioned between said inner wall and said outer wall, each of said flanges defining a mounting portion for receiving a roller, and each of said rollers adapted for facilitating the rotation of said seat carrier ring around said central axis and independently of said seat support ring.

18. The apparatus of claim 15 wherein said seat support ring is integrally formed as part of an activity table, said activity table being adapted for receiving one or more children's activity items.

19. A children's exercise apparatus for providing exercise functionality for a small child, said apparatus comprising:

one or more legs supported on a floor;

a resilient support surface suspended generally horizontally from at least one of the legs and positioned above the floor, said resilient support surface having a resiliency that is adapted for allowing the child to bounce vertically by pushing its legs downwardly against the resilient support surface;

a seat structured to support the child while allowing the child's legs to extend downwardly below the seat toward the resilient support surface; and at least one element under tension to provide the resiliency for the resilient support surface, wherein:

at least one of said one or more legs defines a mounting portions said mounting portion being adapted for securing said resilient support surface to each of said legs at a distance above the floor; and said one or more legs are positioned to extend outwardly and downwardly towards the floor such that the tension of the element increases when the resilient support surface is secured closer to the floor and the tension of element decreases when the resilient support surface is secured farther from the floor.

20. The apparatus of claim 19 wherein said mounting portion includes a plurality of grooves defined in an outer surface of one of said one or more legs, each of said grooves being adapted for receiving a resilient cord and preventing said resilient cord from moving vertically.

21. The apparatus of claim 19 wherein said mounting portion includes a plurality of horizontal slots, each of said horizontal slots being adapted for receiving a tab coupled to said resilient support surface and preventing said tab from moving vertically.

22. The apparatus of claim 19 wherein said mounting portion includes an elongated vertical slot in each of said one or more legs, said vertical slot having a certain width, and said apparatus further comprising a pin adapted for selectively engaging said vertical slot and having an elongated body with a width that is less than the width of the vertical slot and a horizontal stop member, wherein said horizontal stop member has a width greater than said width of said vertical slots, preventing said horizontal stop member from passing through said vertical slot.

23. The apparatus of claim 19 wherein:

said mounting portion includes an elongated vertical slot with a certain width and a plurality of projections extending normally from said legs, said projections being vertically aligned adjacent said vertical slot, and said apparatus further comprising:

a pin adapted for selectively engaging said vertical slot and at least a portion of each of said projections, said pin having an elongated body with a width that is less than the width of the vertical slot, a vertical stop member, and a horizontal stop member, wherein said vertical stop member is positioned along the elongated body and is adapted for engaging the projections extending from said legs, preventing said pin from moving up or down within said vertical slot, and wherein said horizontal stop member has a width greater than said width of said vertical slots, preventing said horizontal stop member from passing through said vertical slot.

24. The apparatus of claim 18 wherein the seat support ring comprises a lower horizontal surface that faces the support surface, the lower surface defining at least one leg mounting portion, and the apparatus further comprises:

one or more C-shaped brackets, each C-shaped bracket having an inner diameter that is substantially the same as an outer diameter of an upper end of the one or more legs, said C-shaped bracket defining at least one aperture, and each C-shaped bracket being disposed around the upper end of each of the one or more legs, wherein said at least one aperture is configured for receiving a fastener therethrough to secure the C-shaped bracket to the lower horizontal surface of the seat support ring.

25. The apparatus of claim 18 wherein:

the seat support ring comprises a lower horizontal surface that faces the support surface, the lower surface defining at least one leg mounting portion, and each leg mounting portion defining at least one aperture for receiving a fastener therethrough, each of the one or more legs having an upper end, the upper end defining at least one aperture for receiving a fastener therethrough, and the at least one aperture in the leg mounting portion being aligned with the at least one aperture in the upper end by the leg being positioned adjacent the leg mounting portion.

* * * * *